US010096931B2

(12) United States Patent
Little et al.

(10) Patent No.: US 10,096,931 B2
(45) Date of Patent: Oct. 9, 2018

(54) CONNECTOR WITH VARIABLE CONTOUR

(71) Applicant: FOXCONN INTERCONNECT TECHNOLOGY LIMITED, Grand Cayman (KY)

(72) Inventors: Terrance F. Little, Fullerton, CA (US); Stephen Sedio, Valley Center, CA (US); Wei-Hao Su, New Taipei (TW); Sheng-Pin Gao, Kunshan (CN); Chih-Ching Hsu, New Taipei (TW); Wei-Kang Liu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 72 days.

(21) Appl. No.: 15/141,845

(22) Filed: Apr. 29, 2016

(65) Prior Publication Data

US 2016/0322767 A1 Nov. 3, 2016

Related U.S. Application Data

(60) Provisional application No. 62/154,769, filed on Apr. 30, 2015.

(30) Foreign Application Priority Data

Nov. 6, 2015 (CN) ..... 2015 1 0747872
Nov. 6, 2015 (CN) ..... 2015 1 0747949

(51) Int. Cl.
*H01R 13/436* (2006.01)
*H01R 13/514* (2006.01)
(Continued)

(52) U.S. Cl.
CPC ..... *H01R 13/516* (2013.01); *H01R 24/64* (2013.01)

(58) Field of Classification Search
CPC .. H01R 13/436; H01R 13/514; H01R 13/629; H01R 13/703; H01R 27/02; H01R 27/00;
(Continued)

(56) References Cited

U.S. PATENT DOCUMENTS 4,611,875 A * 9/1986 Clarke ..... H01R 31/02 439/638
5,562,504 A * 10/1996 Moshayedi ..... G06K 19/07743 439/131
(Continued)

FOREIGN PATENT DOCUMENTS

JP 2008103318 A * 5/2008 ..... H01R 13/33

OTHER PUBLICATIONS

English Translation of JP 2008103318.*

*Primary Examiner* — Michael A Lyons
*Assistant Examiner* — Matthew T Dzierzynski
(74) *Attorney, Agent, or Firm* — Wei Te Chung; Ming Chieh Chang

(57) ABSTRACT

The plug connector includes an insulative housing and a terminal module wherein the terminal module is able to be moveable relative to the housing via sliding or rotation or translation or even detachment so as to have the front mating portion of the terminal module independently mated with the thin receptacle connector or cooperate with the housing to be mated with the regular RJ-45 modular jack.

20 Claims, 31 Drawing Sheets

(51) Int. Cl.
*H01R 13/629* (2006.01)
*H01R 13/516* (2006.01)
*H01R 24/64* (2011.01)

(58) Field of Classification Search
CPC ..... H01R 24/62; H01R 24/64; H01R 31/00; H01R 31/06; H01R 31/005
USPC ..... 439/131, 638, 640
See application file for complete search history.

(56) References Cited

U.S. PATENT DOCUMENTS 5,637,018 A * 6/1997 Gargiulo ..... H01R 31/06 439/131
5,775,951 A * 7/1998 Gargiulo ..... H01R 31/06 439/131
6,115,256 A * 9/2000 Centofante ..... H01R 23/70 361/736
6,164,989 A * 12/2000 Glad ..... H01R 13/447 439/131
6,257,935 B1 7/2001 Zhang et al.
6,565,391 B2 5/2003 Bernstein et al.
6,935,877 B2 * 8/2005 Liao ..... H01R 31/06 439/170
7,014,495 B2 * 3/2006 Carroll ..... H01R 13/582 439/404
7,025,636 B2 * 4/2006 Allen ..... H01R 33/97 439/357
7,108,562 B2 * 9/2006 Liao ..... H01R 13/506 439/170
7,189,089 B1 * 3/2007 Liao ..... H01R 27/00 439/170
7,255,567 B1 * 8/2007 Liao ..... H01R 31/06 439/11
7,416,413 B2 * 8/2008 Liao ..... H01R 31/06 439/11
7,618,262 B2 * 11/2009 Fogg ..... H01R 23/6873 439/11
7,862,384 B2 * 1/2011 Myers ..... H01R 13/6273 439/344
8,465,319 B2 6/2013 Regnier et al.
8,827,726 B2 9/2014 Chen
9,054,460 B2 * 6/2015 Schumacher ..... H01R 13/658
9,350,114 B2 * 5/2016 Liang ..... H01R 13/6275
9,461,409 B2 * 10/2016 Pepe ..... H01R 4/242
2012/0100744 A1 * 4/2012 Bolouri-Saransar ..... H01R 13/6469 439/404
2012/0164868 A1 6/2012 Huang et al.
2013/0072042 A1 3/2013 Liao
2013/0109225 A1 5/2013 Liu
2014/0187064 A1 7/2014 Yu et al.
2015/0037990 A1 2/2015 Yu et al.
2015/0180165 A1 * 6/2015 Maranto ..... H01R 13/5829 439/391
2016/0282564 A1 * 9/2016 Little ..... G02B 6/3817

* cited by examiner

CONNECTOR WITH VARIABLE CONTOUR

CROSS REFERENCE TO RELATED APPLICATIONS

This application claims the benefit of, and priority to U.S. Provisional Patent Application No. 62/154,769 filed Apr. 30, 2015, Chinese Patent Application No. 201510747872.9 filed Nov. 6, 2015, and Chinese Patent Application No. 201510747949.2 filed Nov. 6, 2015, the contents of which are incorporated entirely herein by reference.

BACKGROUND OF THE INVENTION

1. Field of the Invention

The present invention relates to a plug connector with capability of mating with differently dimensioned/configured receptacle connectors while sharing the same contact arrangement thereof.

2. Description of Related Art

The RJ-45 modular jack and the corresponding plug are popularly used in the computer and communication field. Anyhow, for the tablet or ultrabook which has very thin thickness and less space to install the regular RJ-45 modular jack, it is almost impossible to use the regular RJ-45 plug connector for such an Internet connection. Therefore, a specific thin receptacle connector is desired to be equipped within the tablet or ultrabook in addition to the wireless connection device, which has the similar electrical interface with the current RJ-45 and adapted to mate with the modified plug connector.

SUMMARY OF THE INVENTION

Accordingly, the object of the present invention is to provide a plug connector connected with a cable for server communication or Internet communication, wherein the plug connector is capable of changing the contour so as to be adapted to be mated with not only the regular RJ-45 modular jack built within the desktop or notebook computer but also the thin receptacle connector built within the tablet or the ultrabook. Therefore, the plug connector includes an insulative housing and a terminal module wherein the terminal module is able to be moveable relative to the housing via sliding or rotation or translation or even detachment so as to have the front mating portion of the terminal module independently mated with the thin receptacle connector or cooperate with the housing to be mated with the regular RJ-45 modular jack.

Another object of the invention is to provide a thin receptacle connector built within the tablet or the ultrabook. The thin receptacle connector includes an insulative case forming a front mating cavity and a plurality of terminals having mating portions received within the front mating cavity to mate with a plug connector to transmit network signals. The insulative case has a rectangle contour which is thinner than the standard RJ-45 modular jack in a vertical direction.

Another object of the invention is to provide an adapter to connect between a traditional/standard RJ-45 plug connector and the thin receptacle connector.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
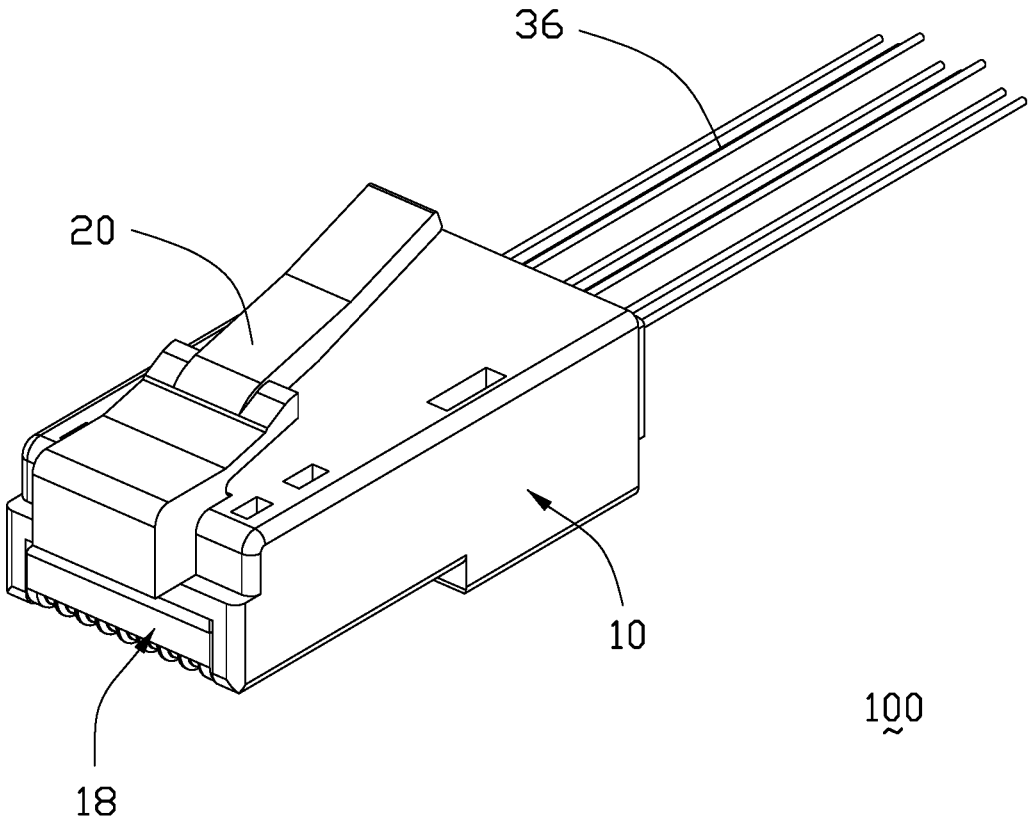
FIG. 1(A) is a front downward perspective view of the plug connector according to a first embodiment of the invention wherein the plug connector is configured to be mated with the regular RJ-45 modular jack.
Figure 1B:
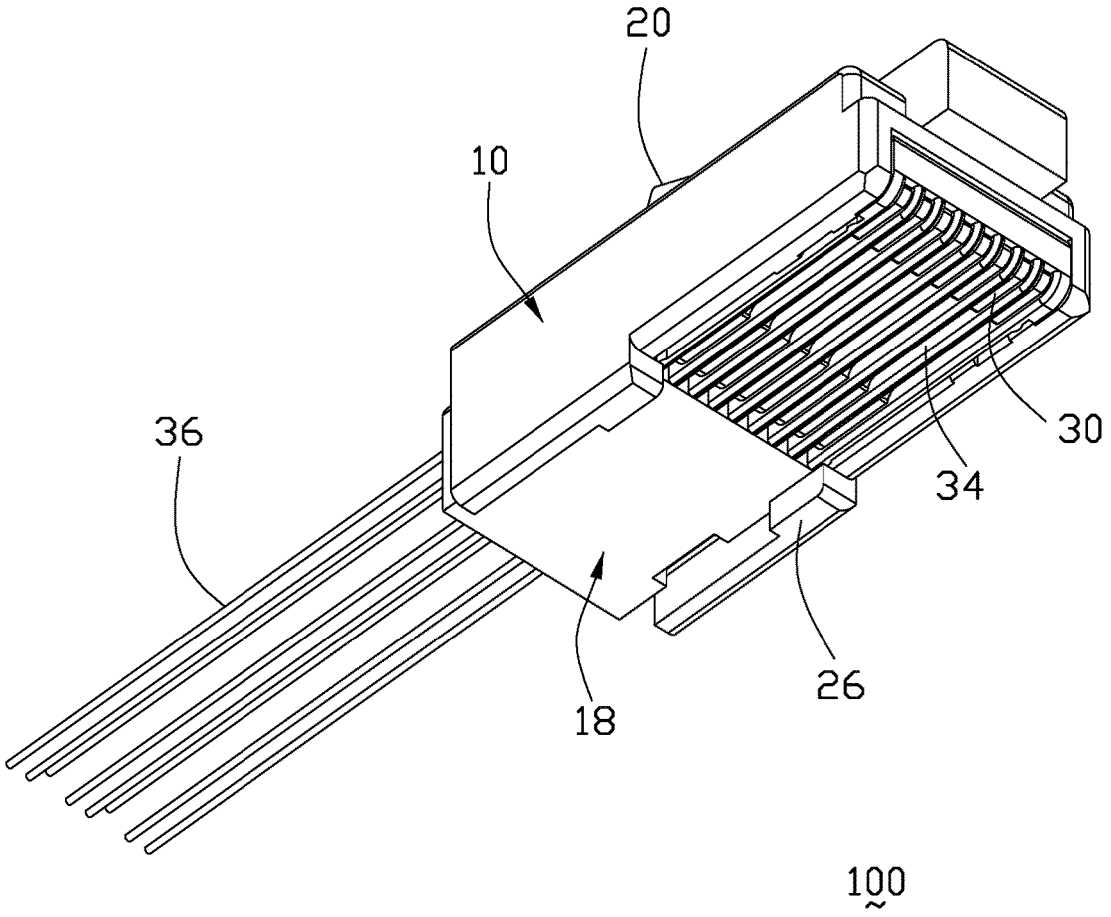
FIG. 1(B) is a front upward perspective view of the plug connector of FIG. 1(A).
Figure 2A:
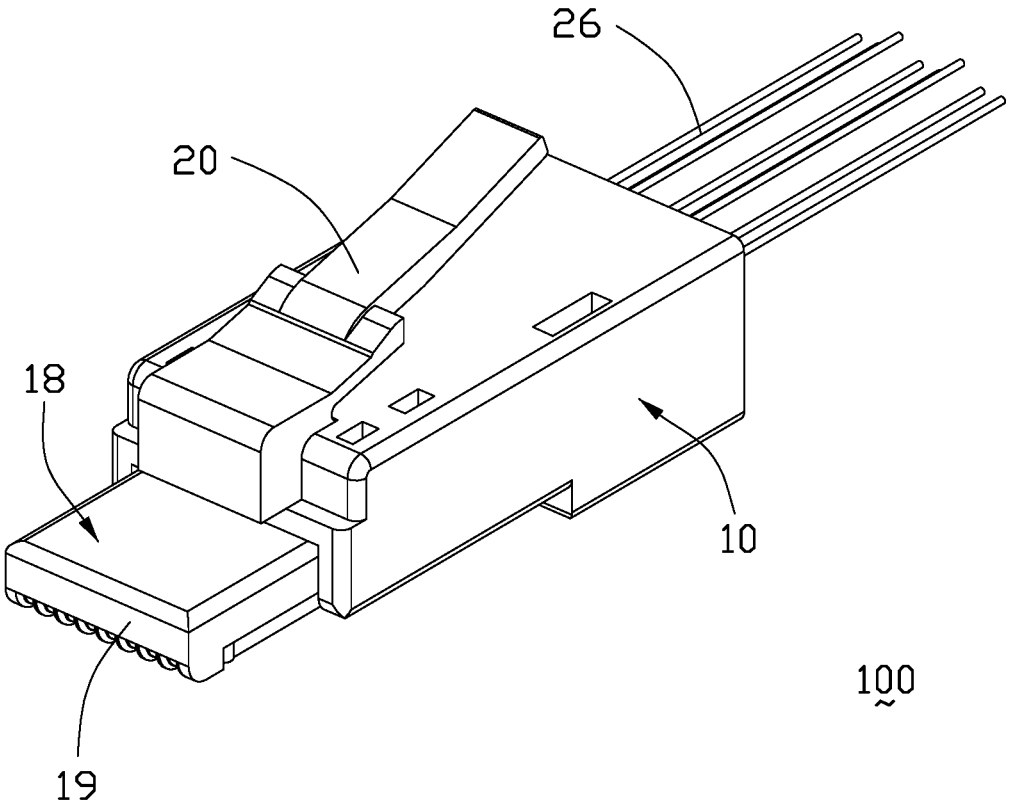
FIG. 2(A) is a front downward perspective view of the plug connector of FIG. 1(A) wherein the plug connector is configured to be mated with the thin receptacle connector.
Figure 2B:
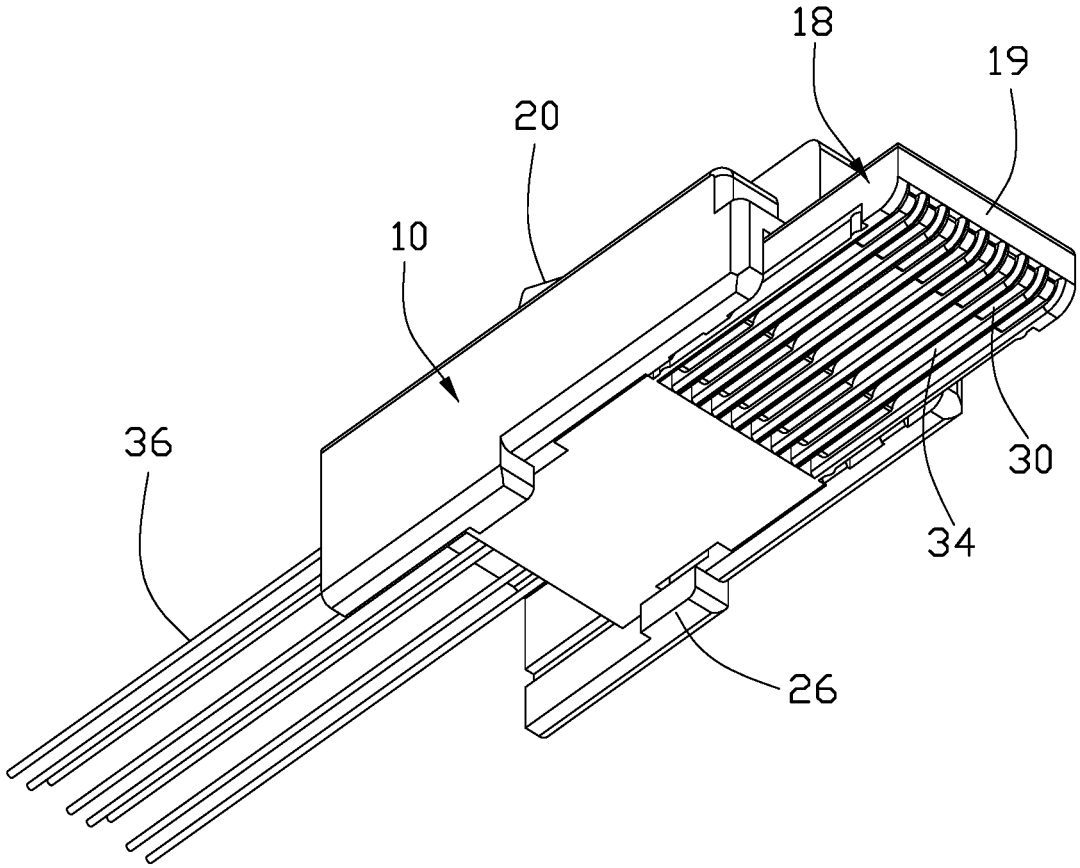
FIG. 2(B) is a front upward perspective view of the plug connector of FIG. 2(A).
Figure 3A:
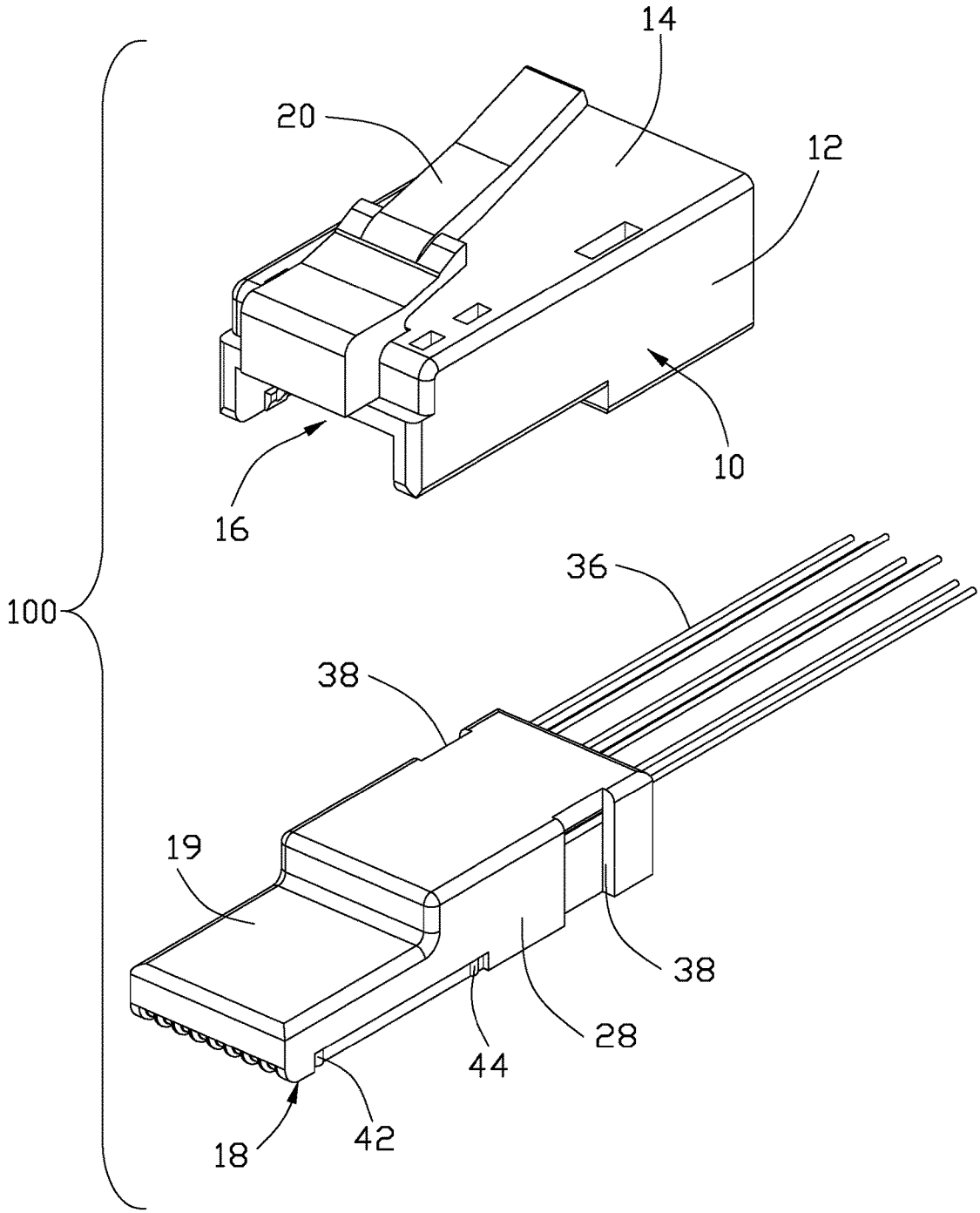
FIG. 3(A) is a front downward exploded perspective view of the plug connector of FIG. 1 (A).
Figure 3B:
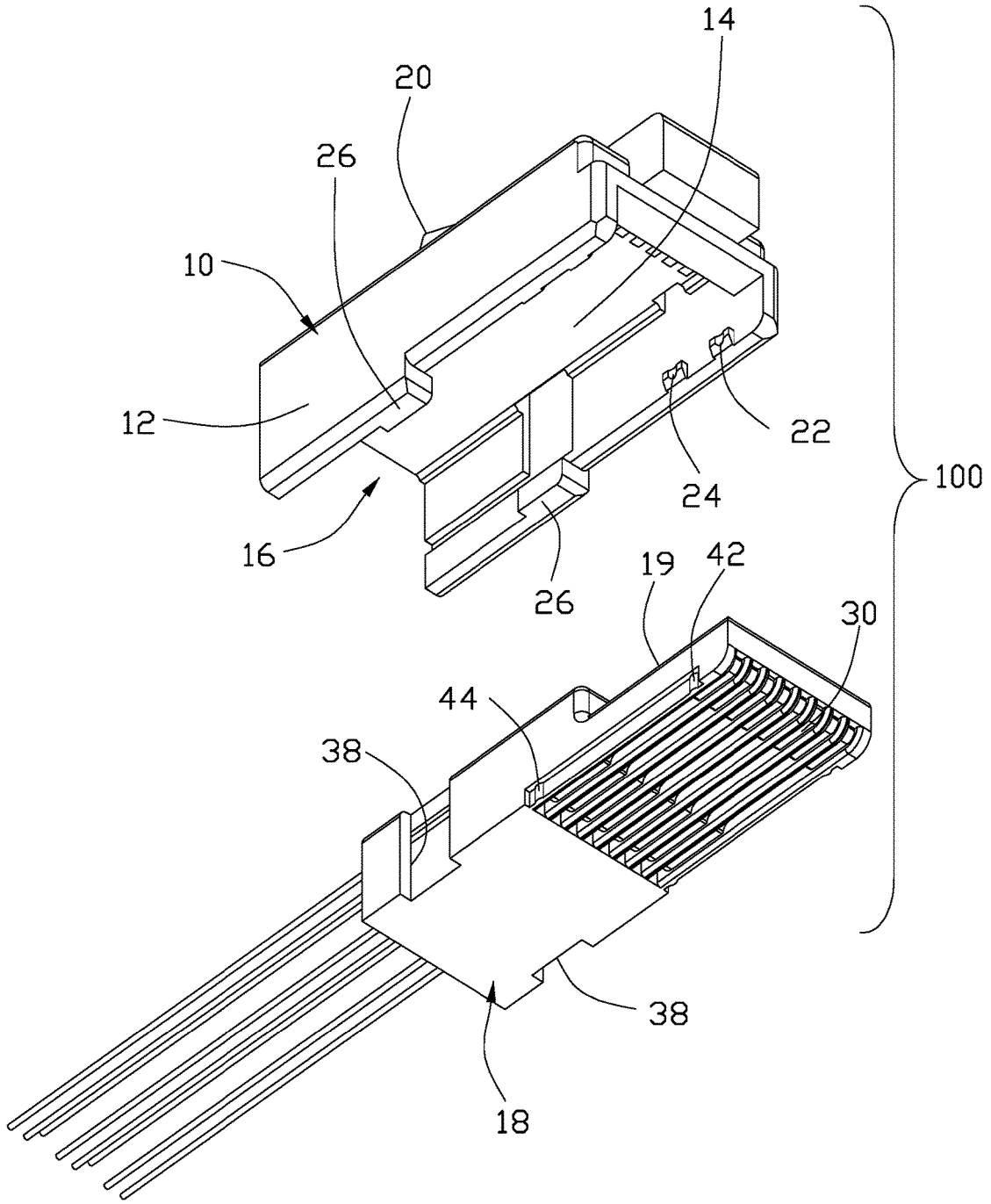
FIG. 3(B) is a front upward exploded perspective view of the plug connector of FIG. 3(A).
Figure 3C:
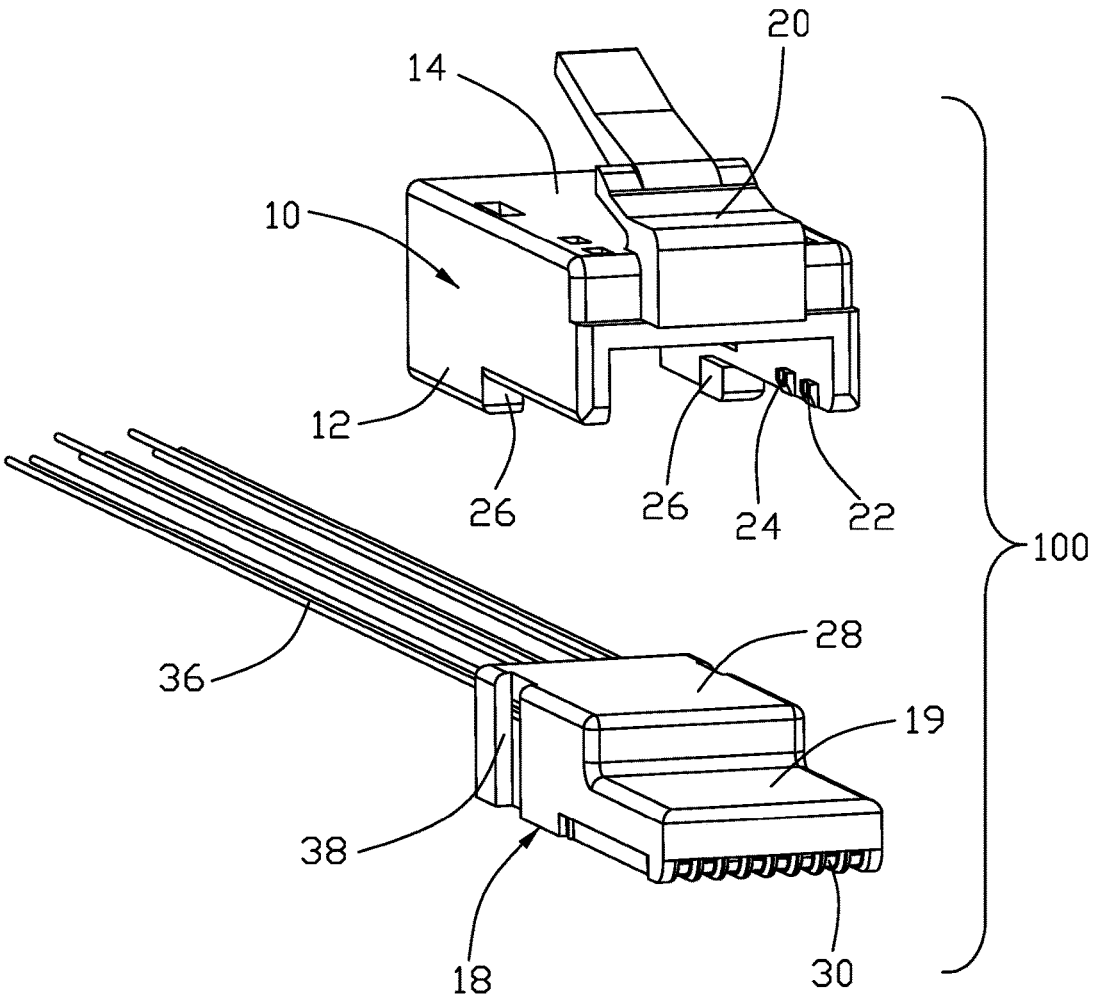
FIG. 3(C) is another front downward exploded perspective view of the plug connector of FIG. 3(A).
Figure 3D:
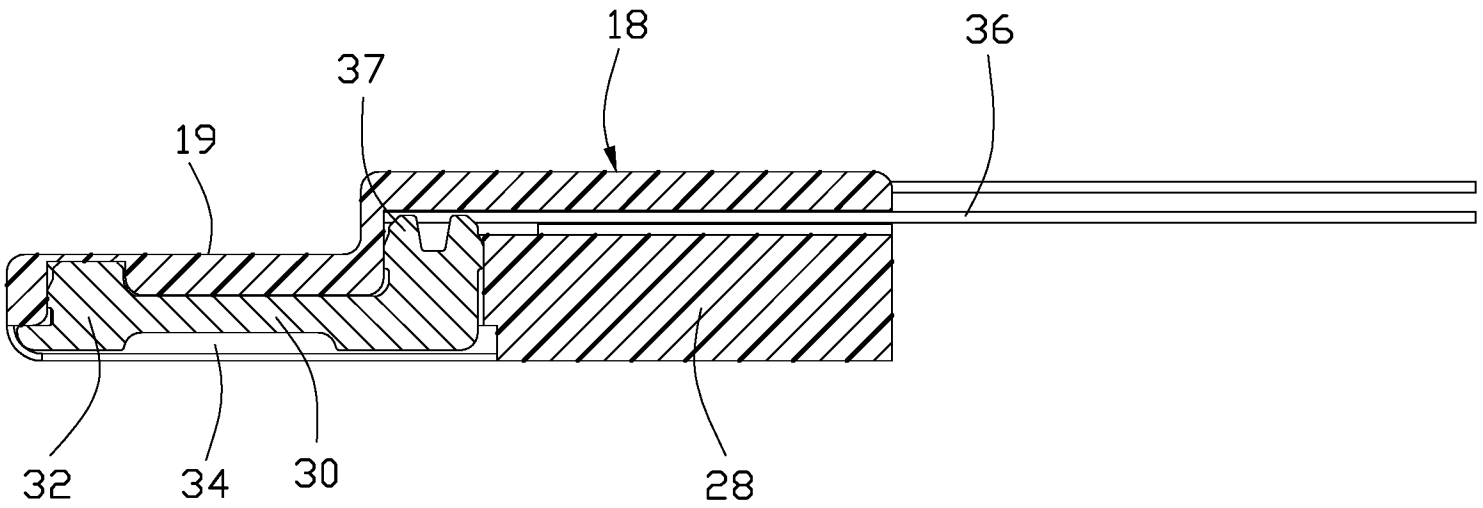
FIG. 3(D) is a cross-sectional view of the terminal module of the plug connector of FIG. 3(A).
Figure 4A:
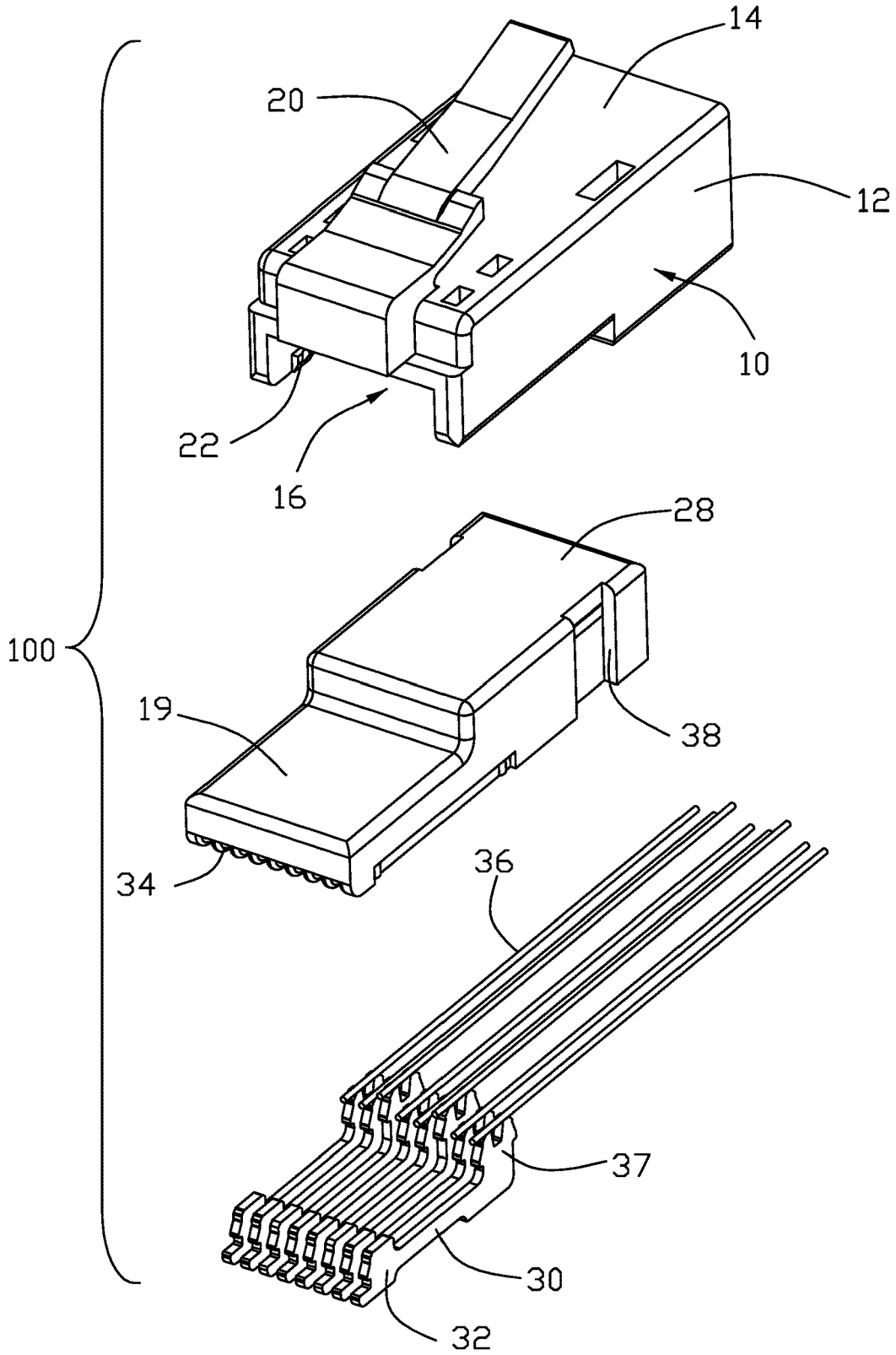
FIG. 4(A) is a further front downward exploded perspective view of the terminal module of the plug connector of FIG. 3(A).
Figure 4B:
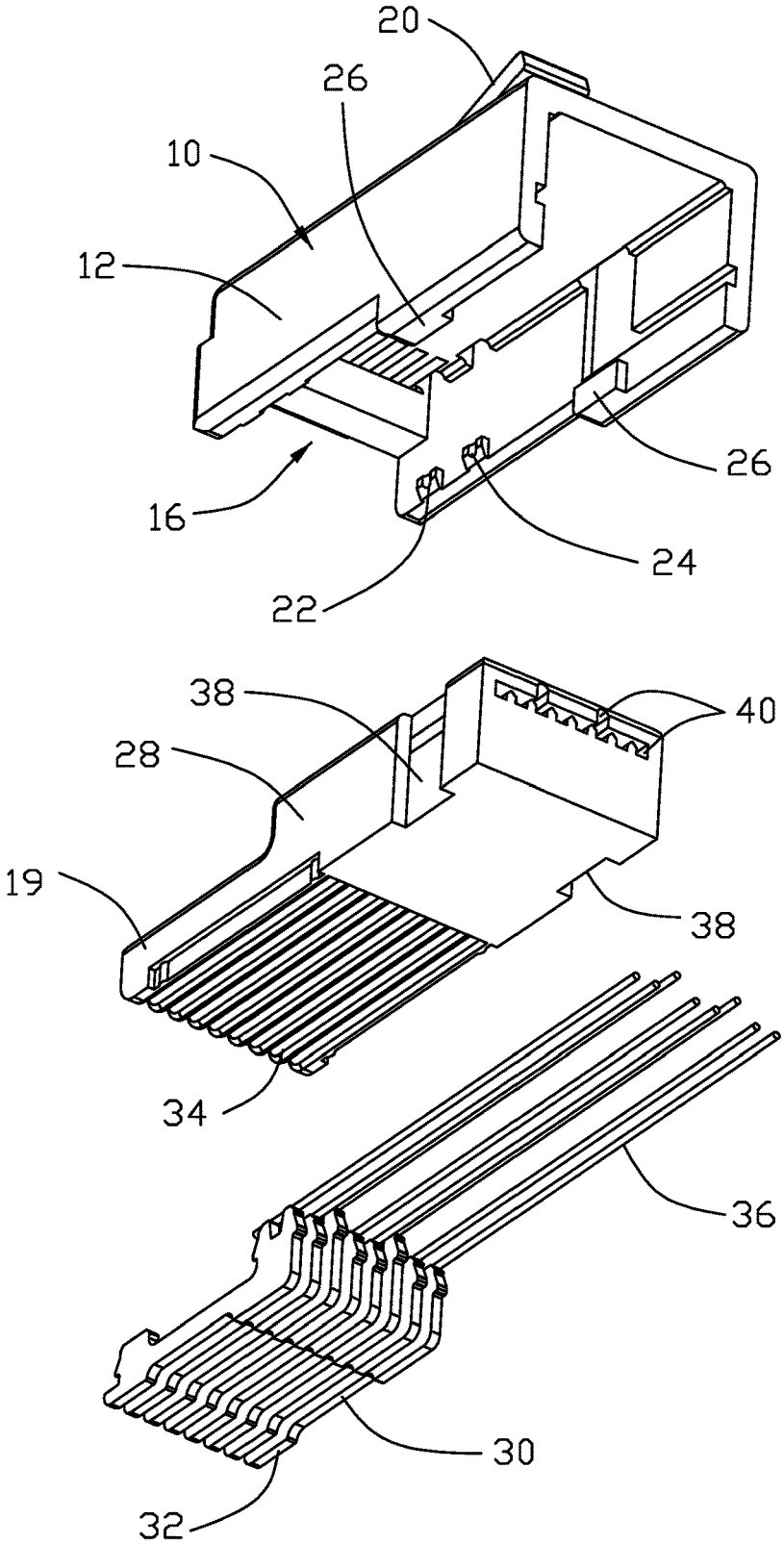
FIG. 4(B) is a further front upward exploded perspective view of the terminal module of FIG. 4(A).
Figure 5A:
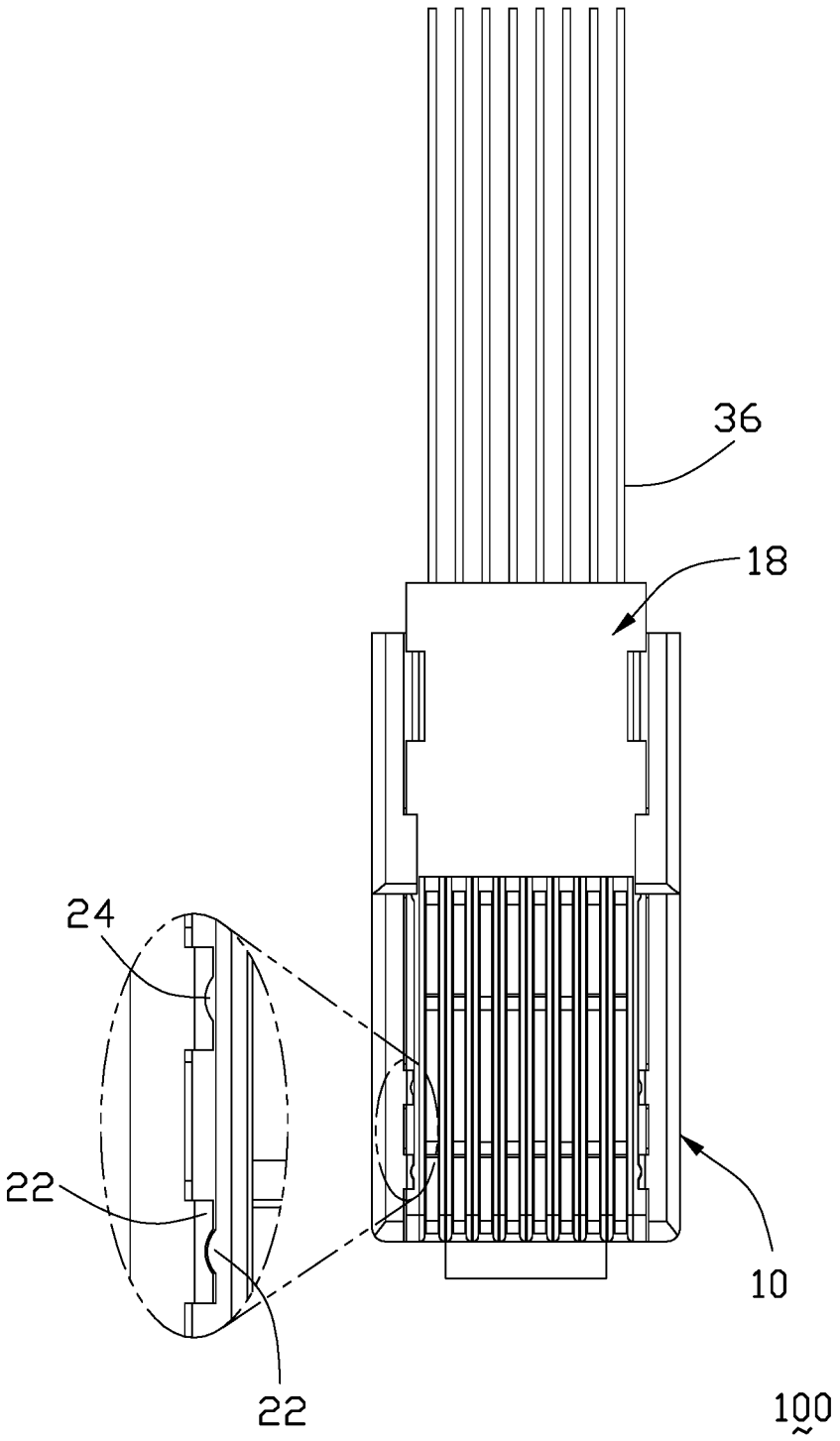
FIG. 5(A) is an elevational view of the plug connector of FIG. 1(A) wherein the terminal module is retracted behind a front edge of the housing for mating with the standard RJ-45 modular jack.
Figure 5B:
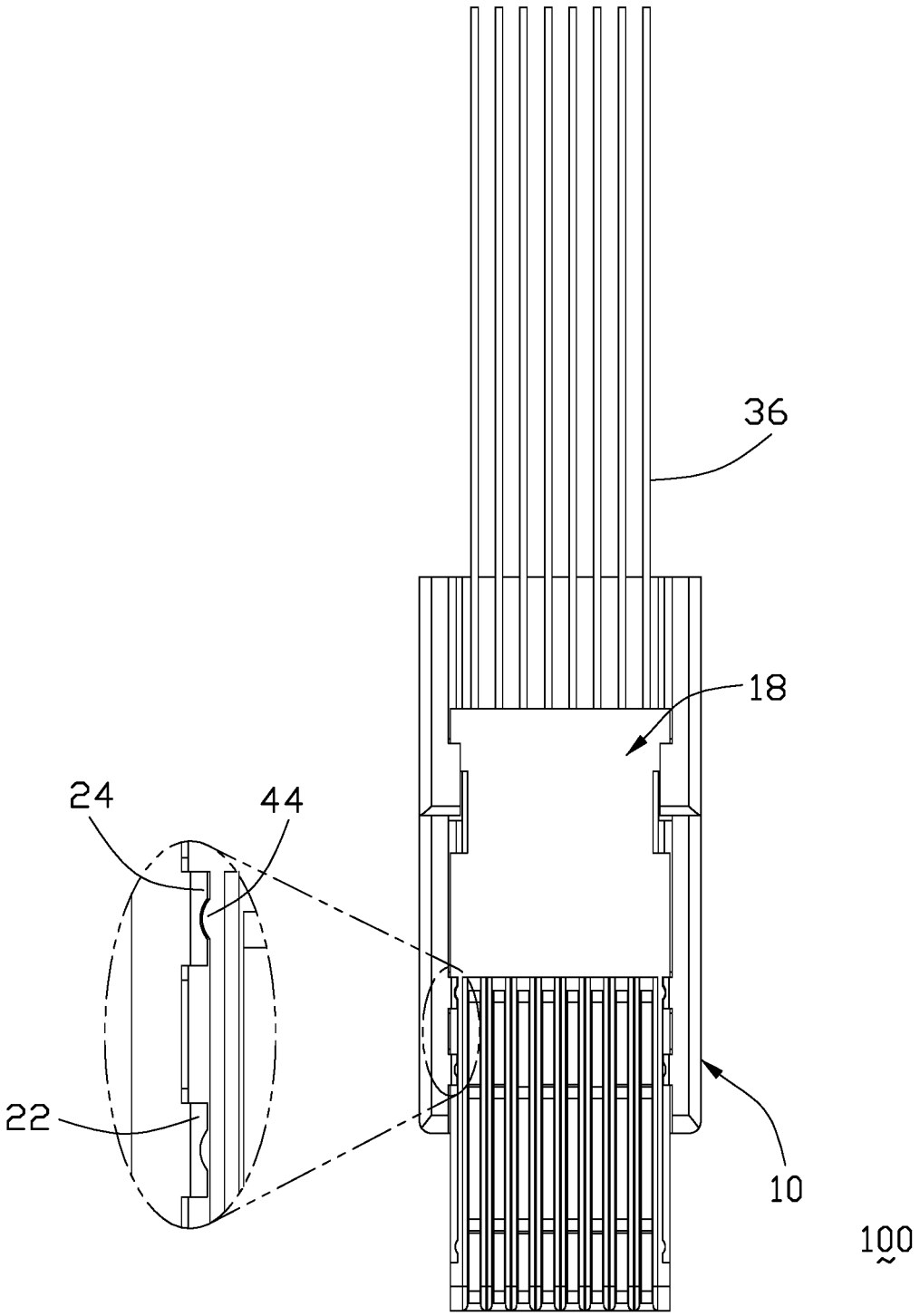
FIG. 5(B) is another eleventional view of the plug connector of FIG. 1(A) wherein the terminal module forwardly protrudes out of the front edge of the housing for mating with the thin receptacle connector.
Figure 6:
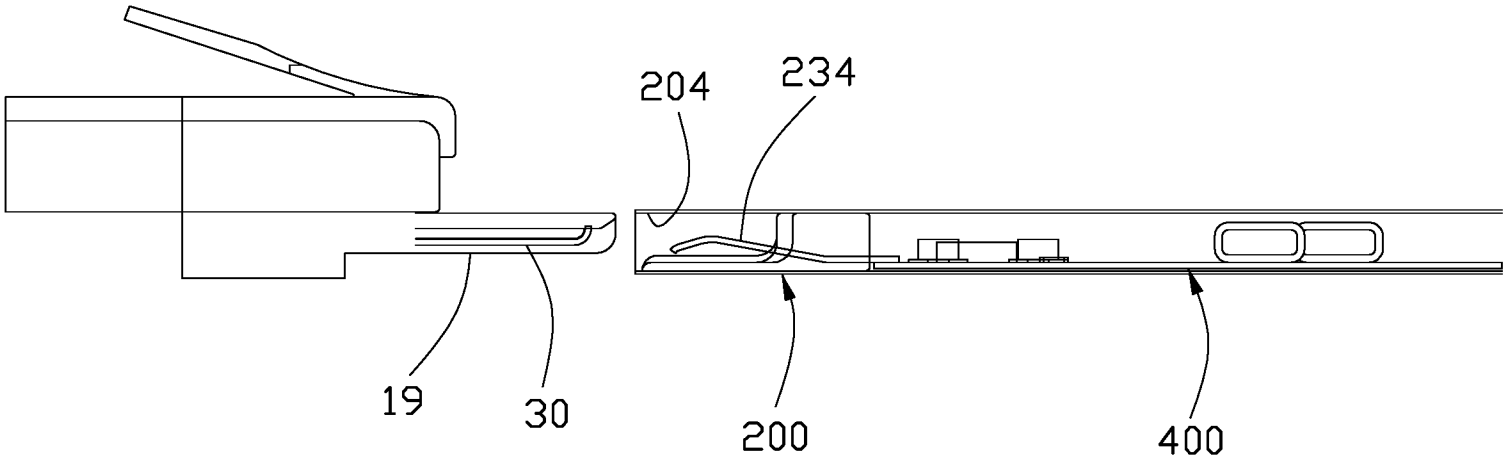
FIG. 6 is an illustrative side view of the plug connector of FIG. 1(A) to be mated with the thin receptacle connector.
Figure 7:
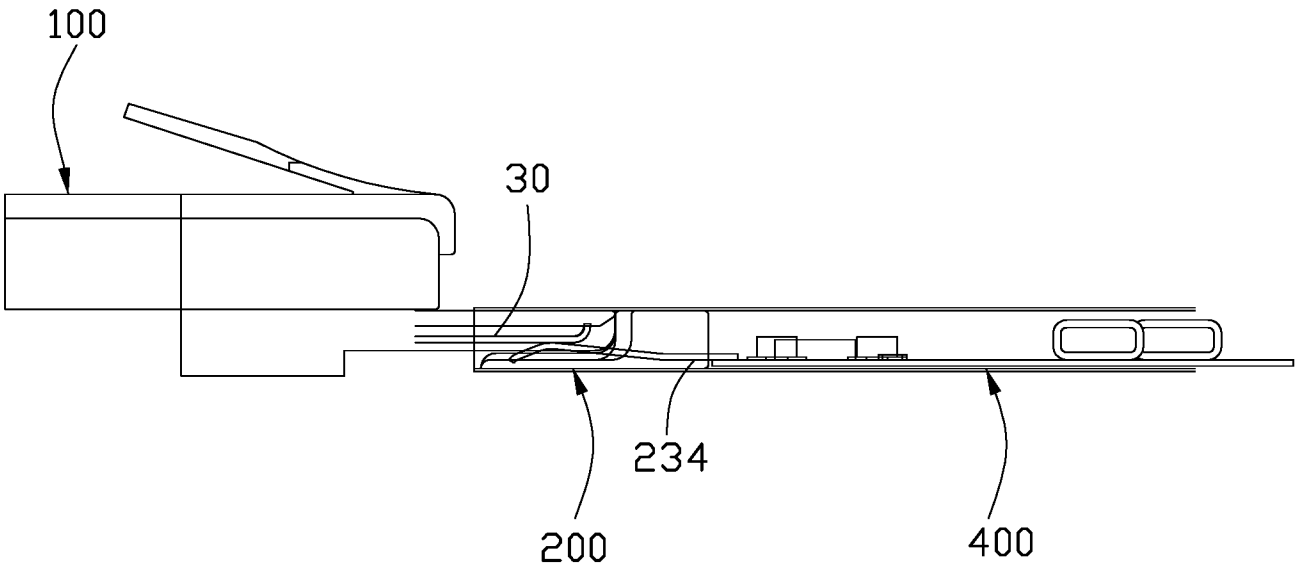
FIG. 7 is an illustrative side view of the plug connector of FIG. 1(A) mated with the thin receptacle connector.
Figure 8:
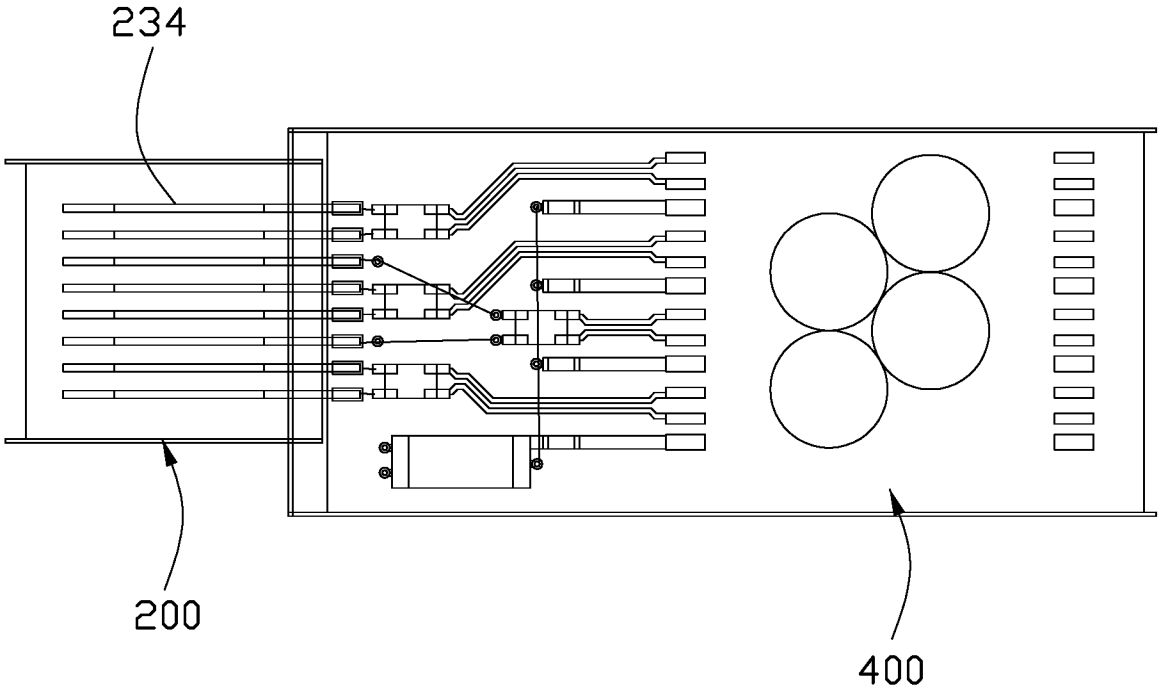
FIG. 8 is a top view of the thin receptacle connector and the associated printed circuit board of FIG. 6 with the corresponding components and circuit traces thereon.
Figure 8A:
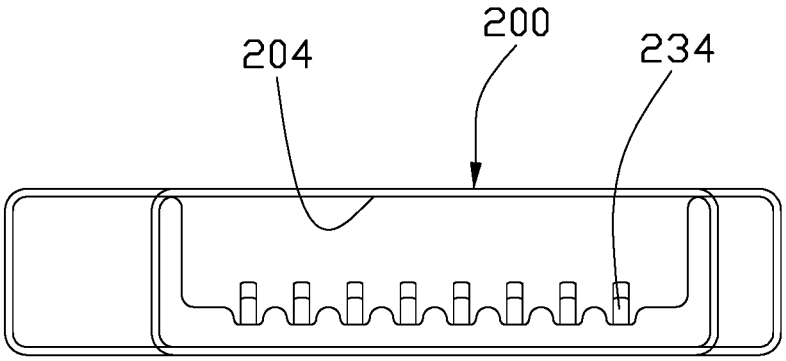
FIG. 8(A) is a front elevational view of the receptacle connector of FIG. 6.

Reference will now be made in detail to the preferred embodiment of the present invention.

FIGS. 1(A)-5(B) show an extendable plug connector 100 including an insulative housing 10 having a pair of side walls 12 and a top wall 14 joined therebetween to commonly form a receiving space 16 to receive a terminal module 18 therein wherein the receiving space 16 is open to an exterior downwardly in the vertical direction and also in a front-to-back direction. The housing 10 integrally forms a deflectable latch 20 around a top side for latching with the regular RJ-45 modular jack. A first pair of positioning detention structures 22 and 24 are formed on each side interior surface along a front-to-back direction. A pair of blocks 26 are formed around bottom edges of the opposite side walls 12 of the housing 10.

The terminal module 18 includes an insulator 28 with a plurality of blade type contacts 30 side by side disposed therein. Each of the contacts 30 includes a front contacting section 32 exposed within the corresponding slot 34 of the insulator 28. A plurality of wires 36 are mechanically and electrically connected to the tail section 37 of the corresponding contacts 30 via an IDC (Insulation Displacement Contact) manner. A pair of assembling grooves 38 are formed in two opposite side surfaces to comply with the corresponding blocks 26. A plurality of wire passages 40 are formed in the rear side of the insulator 28 to receive the corresponding wires 36 therein. A second pair of positioning detention structures 42, 44 are formed on each side face of the insulator 28 to cooperate with the first pair of positioning detention structures 22, 24 to retain the terminal module 18 with regard to the housing 10 at different front/extended position or rear/retracted position (illustrated later).

Figure 12:
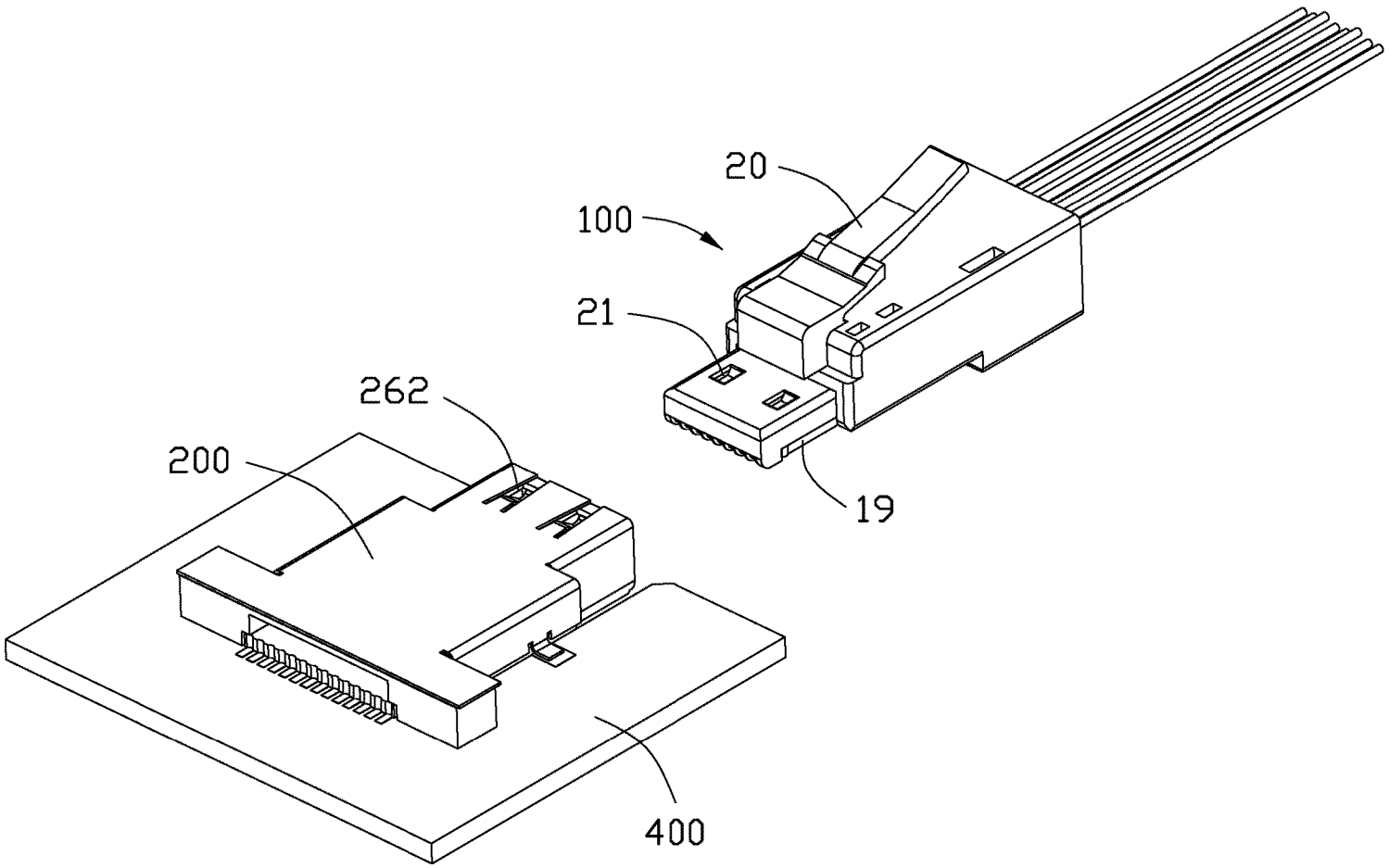
FIG. 12 is a front downward perspective view of the plug connector according to the first embodiment of the invention and the receptacle connector mounted on a motherboard.

During assembling, initially the wires 36 are forwardly inserted into the corresponding wire passages 40 from the rear side of the insulator 28, and successively the contacts 30 are upwardly inserted into the corresponding slots 34 from the bottom side to pierce into the corresponding wires 30, respectively, to establish the mechanical and electrical connection therebetween. Then the pre-assembled terminal module 18 are upwardly inserted into the receiving space 16 from the bottom side of the housing 10 wherein the blocks 26 are aligned with and received within the corresponding assembling grooves 38, respectively. Understandably, in this embodiment, the two side walls 12 are somewhat outwardly deflectable to compromise the corresponding assembling grooves 38 while resume back to the original positions after the terminal module 18 is fully upwardly assembled into the receiving space 16 so as to assure the terminal module 18 can not be withdrawn from the housing 10. Once assembled, the terminal module 18 is able to be slide between the front extended position regulated by engagement between the detention structures 44 and 24 where the front mating portion 19 extends beyond a front edge of the housing 10 to be adapted to be mated with the corresponding thin receptacle connector 200 (illustrated later), and the rear retracted position regulated by engagement between detention structures 22 and 42 where the front mating portion 19 of the terminal module 18 is hidden behind the front edge of the housing 10 so as to be adapted to be mated with the standard RJ-45 module jack which is popularly used for the communication servers or the Internet connection of the computer. FIG. 12 shows a pair of locking holes 21 formed on a top wall of the front mating portion 19.

FIGS. 6-8(A) show the corresponding thin receptacle connector 200 and the associated motherboard 400 located within the tablet and ultrabook computer wherein the receptacle connector 200 forms an ultra thin mating cavity 204 dimensioned to have only the front mating portion 19 of the terminal module 18 received therein to have the contacts 30 mechanically and electrically connect to the corresponding deflectable contacts 234 of the receptacle connector 200.

Figure 13:
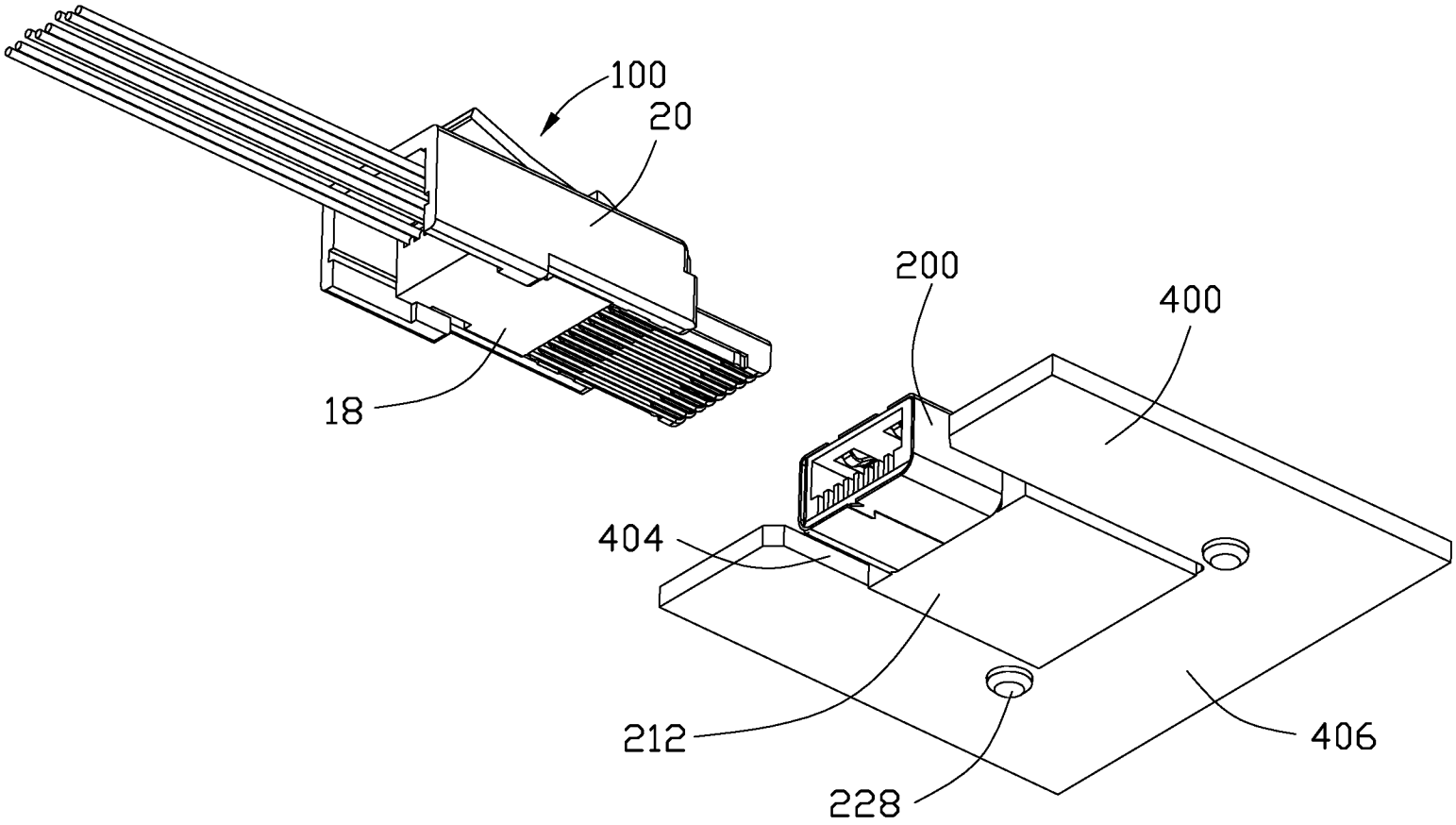
FIG. 13 is a rear upward perspective view of the plug connector according to the first embodiment of the invention and the receptacle connector mounted on the motherboard.
Figure 14:
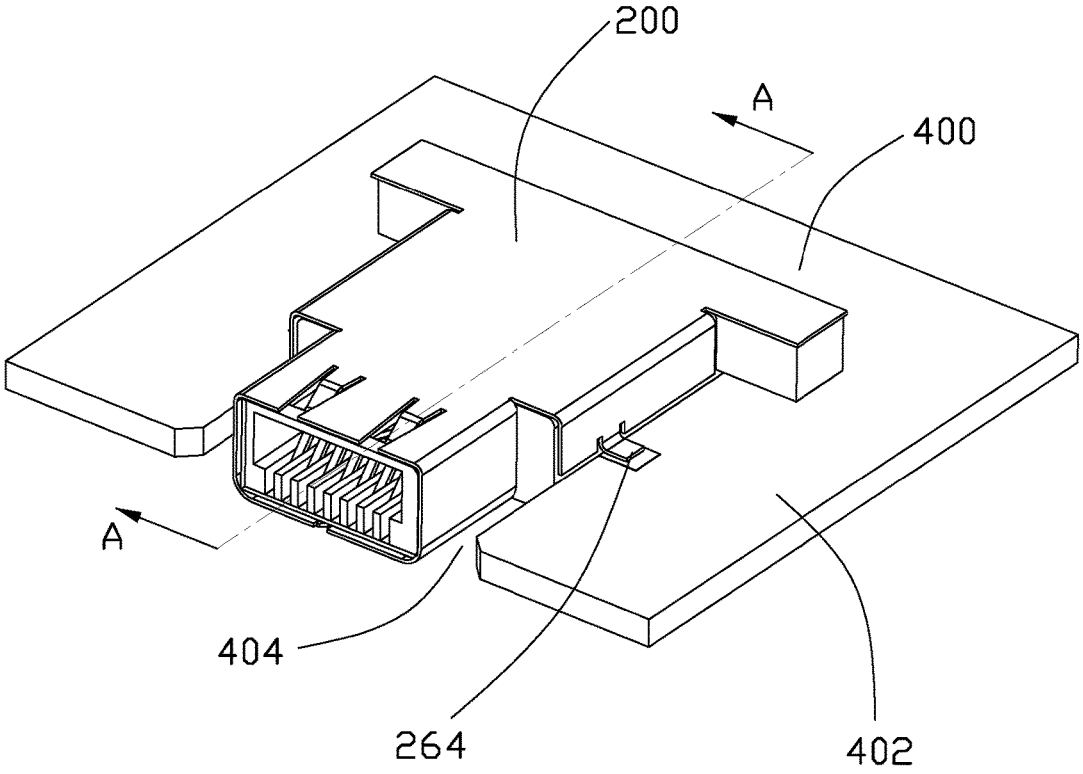
FIG. 14 is a front downward perspective view of the receptacle connector mounted on the motherboard of the FIG. 12.
Figure 15:
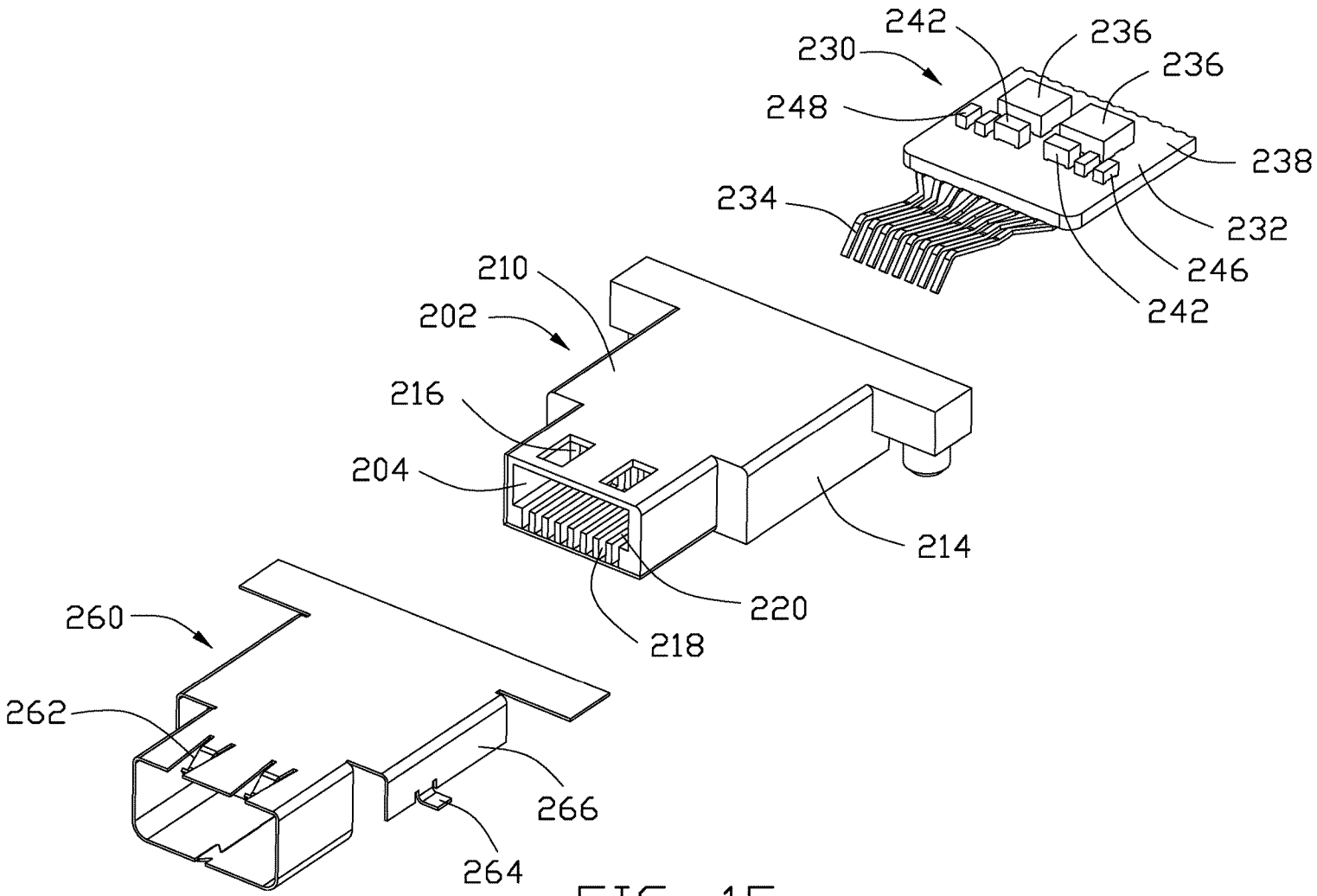
FIG. 15 is a front exploded perspective of the receptacle connector of the FIG. 14.
Figure 16:
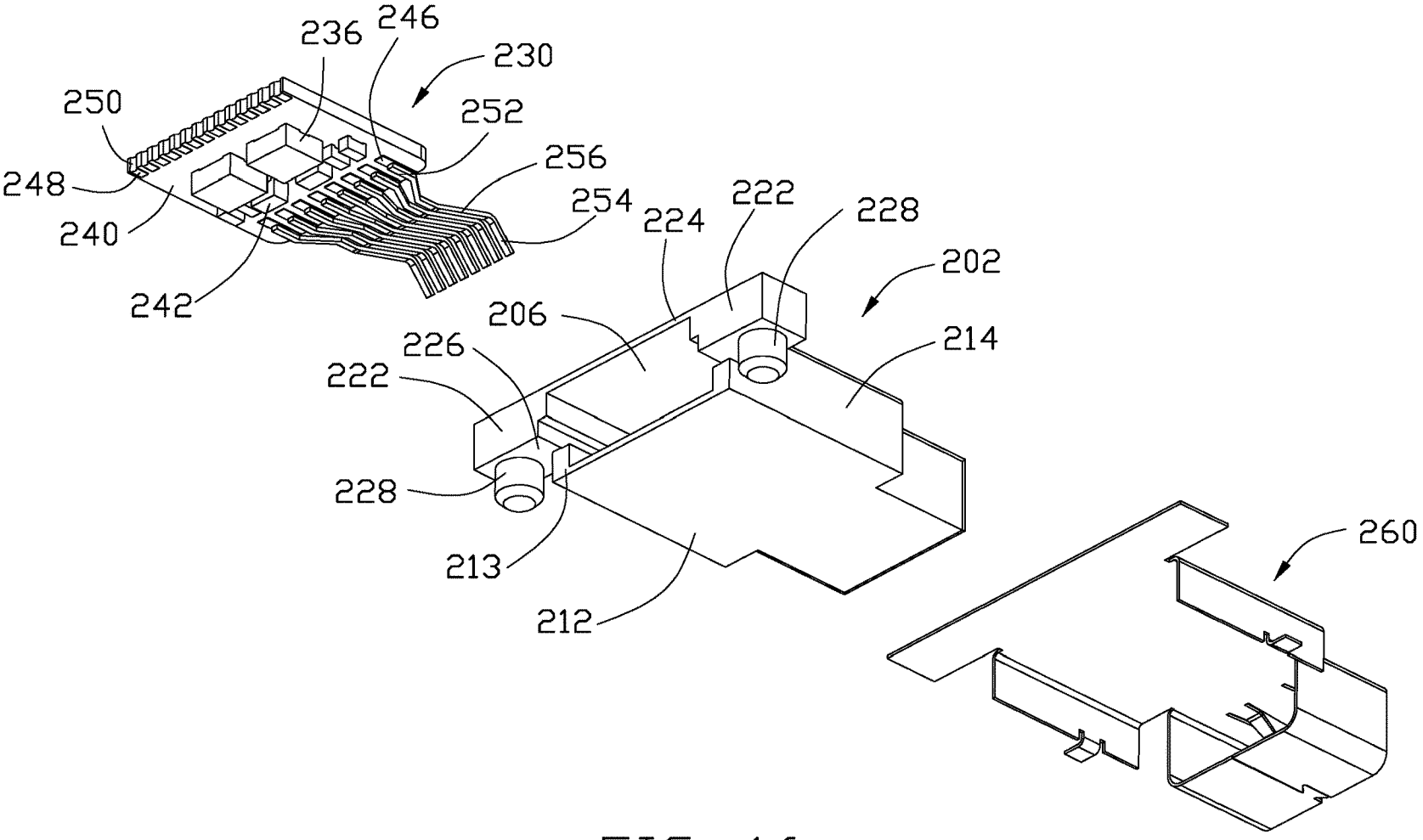
FIG. 16 is a rear exploded perspective of the receptacle connector of the FIG. 14.
Figure 17:
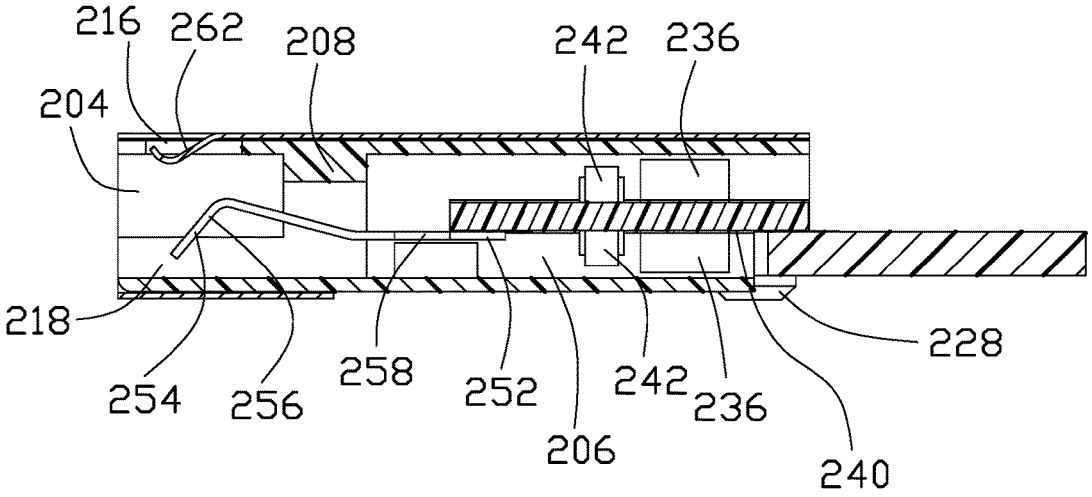
FIG. 17 is a cross-sectional view of the receptacle connector mounted on the motherboard of the FIG. 14.
Figure 18:
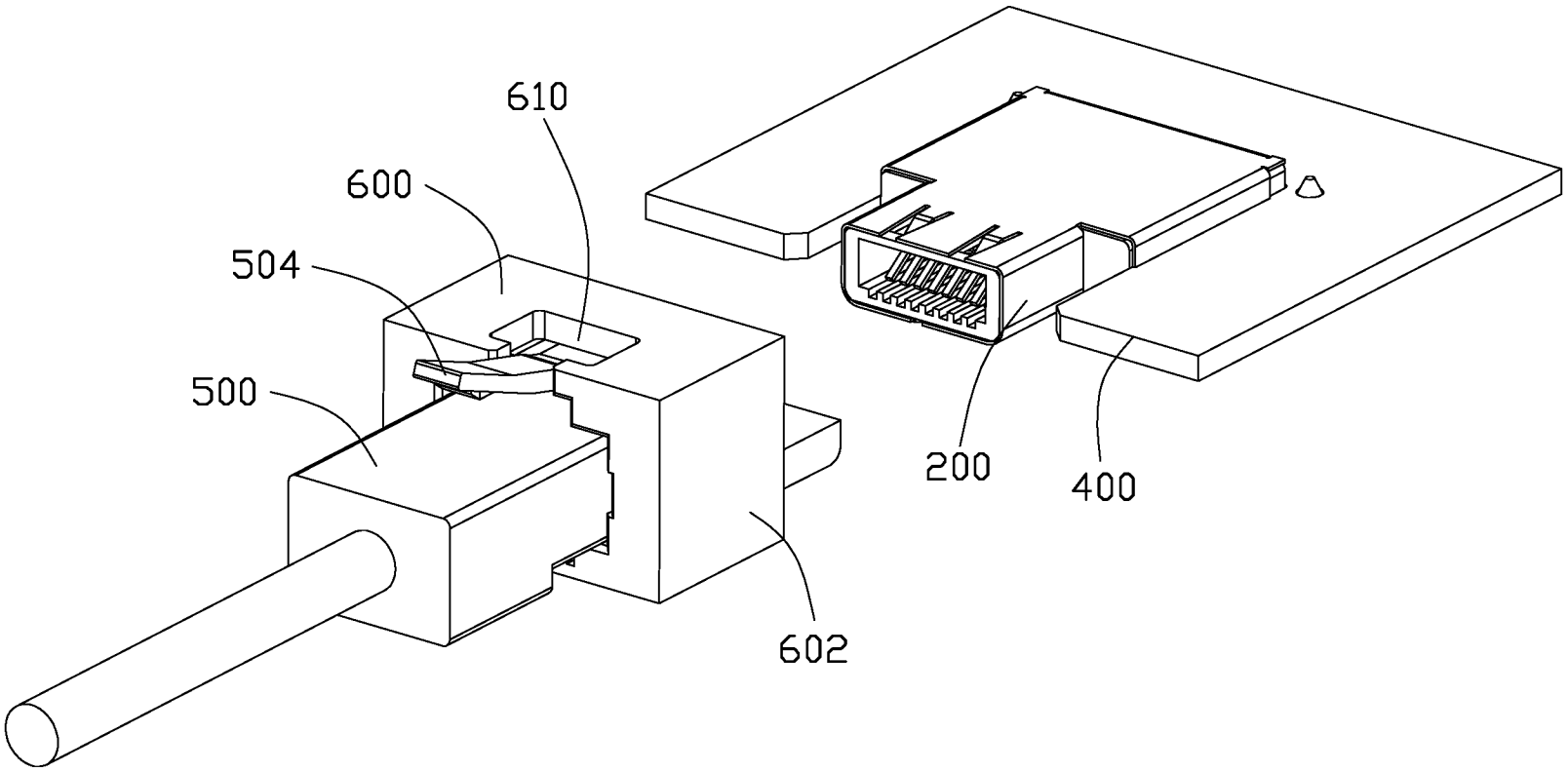
FIG. 18 is a front downward perspective view of a RJ-45 plug connector, an adapter mounted on the RJ-45 plug connector, and the receptacle connector mounted on a motherboard.
Figure 19:
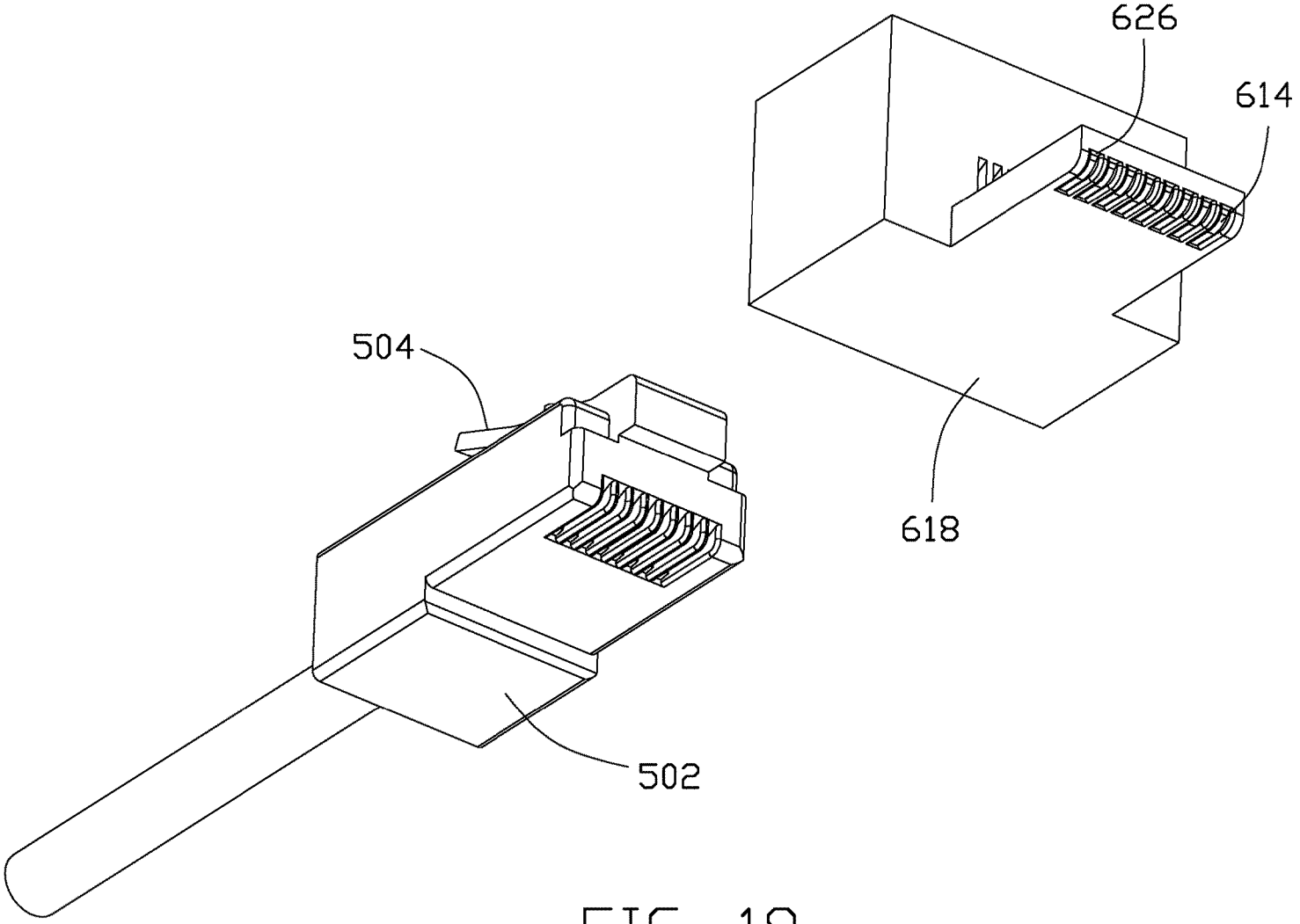
FIG. 19 is a front upward perspective view of the RJ-45 plug connector and the adapter.
Figure 20:
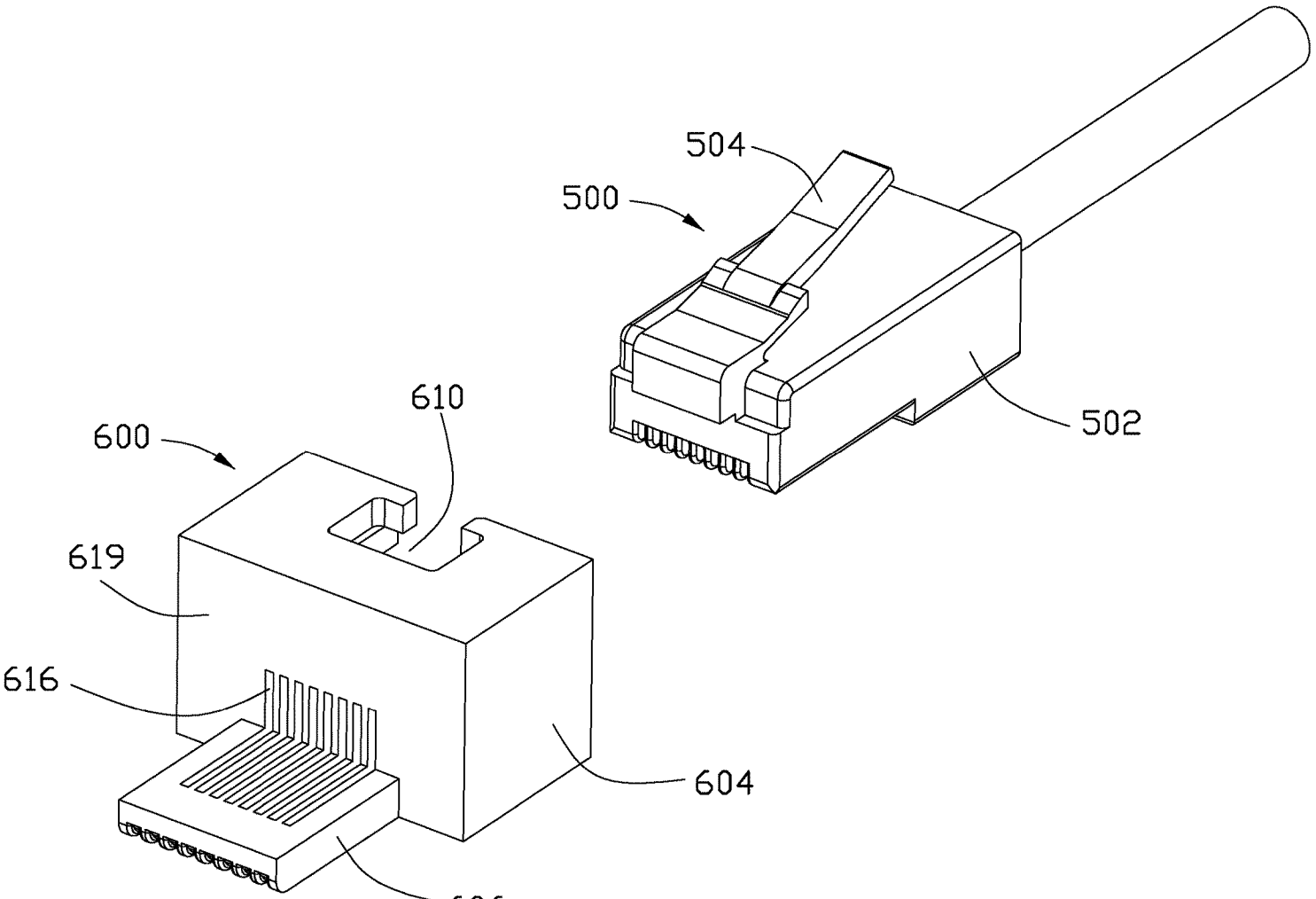
FIG. 20 is a front downward perspective view of the RJ-45 plug connector and the adapter.
Figure 21:
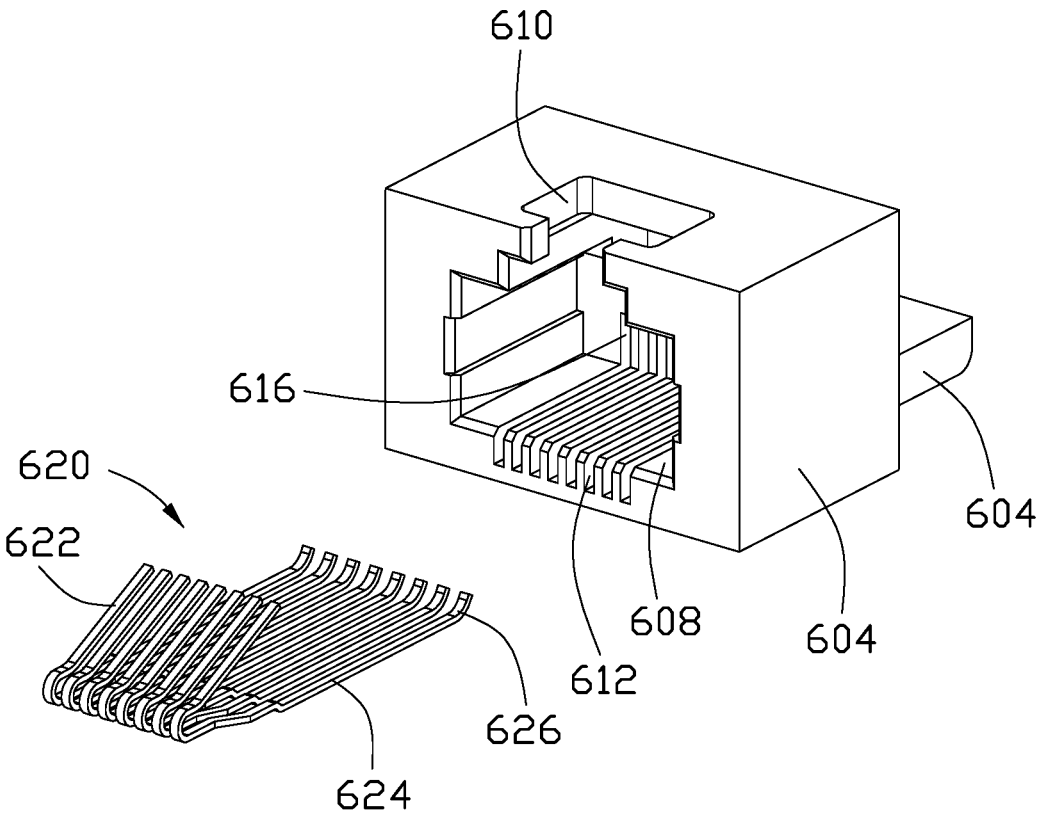
FIG. 21 is a front downward exploded perspective view of the adapter.
Figure 22:
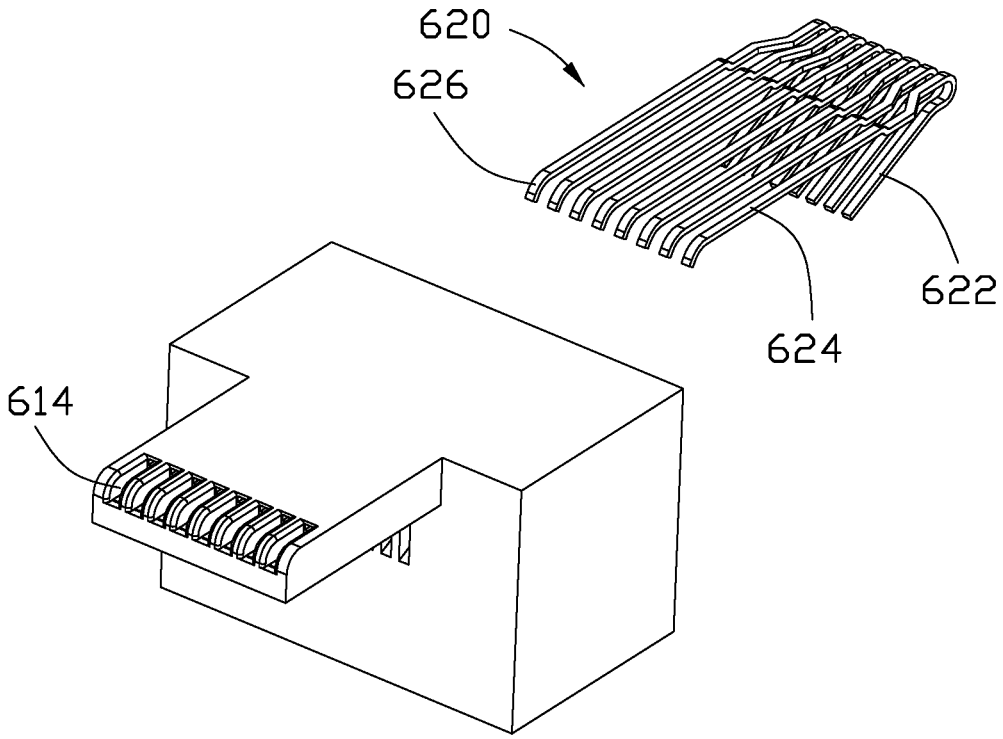
FIG. 22 is a front upward exploded perspective view of the adapter.
Figure 23:
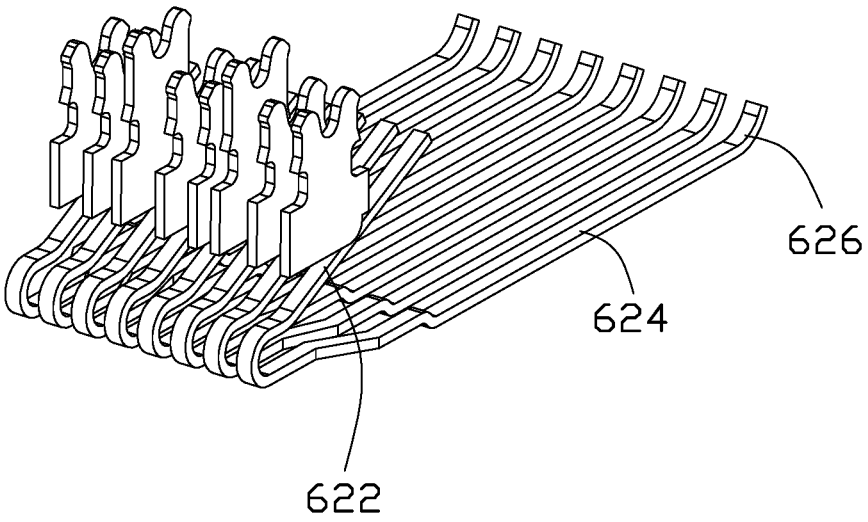
FIG. 23 is a perspective view of the blade contacts of the RJ-45 plug connector and the contacts of the adapter.

FIGS. 12-13 shows the plug connector 100 and the receptacle connector 200 mounted on a mother board 400, wherein the front mating portion 19 of the plug connector 100 is slide forwardly out of the insulative housing 10 and is not mated with the thin receptacle connector 200.

FIGS. 14-17 shows the thin receptacle connector 200 sited on the motherboard 400. The receptacle connector 200 includes an insulative case 202 defining a front mating cavity 204, a rear mounting cavity 206, and a middle wall 208 disposed therebetween. The mating cavity 204 communicates with the mounting cavity 206 along a front-to-back direction. The inslulative case 202 includes an upper wall 210, a lower wall 212, and a pair of lateral walls 214. A pair of through-holes 216 are formed in the upper wall 210 and extended therethrough along a vertical direction perpendicular to the front-to-back direction. The through-holes 216 are located around a front surface of the inslulative case 202 and communicate to the mating cavity 204 along the vertical direction. A plurality of passageways 218 are formed in the lower wall 212 to communicate with the mating cavity 206 along the vertical direction. A plurality of partitions 220 are formed on the lower wall 212 to be arranged in a row along a transverse direction, wherein each partition 220 is located between two neighbored passageways 218. A pair of wings 222 extend from the corresponding lateral walls 214 along the transverse direction, respectively. Each wing 222 has a top surface connected and aligned to the top surface of the inslulative case 202. Each wing 222 has a rear surface 224 behind the rear surfaces 213 of the lateral walls 214 and a lower surface 226 above the lower wall 212. A pair of mounting posts 228 extend downwardly from the corresponding lower surfaces 226 and beyond the lower wall 212, respectively. The lower surfaces 226 are mounted on a top surface 402 of the motherboard 400. The lower wall 212 is inserted into a cutout 404 of the motherboard 400. The mounting posts 228 are inserted into the corresponding though-holes of the motherboard 400 and extend downwardly beyond the bottom surface 406 of the motherboard 400. Notably, the insulative case 202 has a rectangle contour which has not a lock part to lock with the deflectable latch of the plug connector 100 that it could be manufactured enough thin to decrease the thickness thereof.

A contact assembly 230 has a printed circuit board (PCB) 232 received in the mounting cavity 206 with a plurality of mating contacts 234 connected to a front section thereof. A plurality of transformers 236 are surface-mounted on the PCB 232, wherein two transformers 236 are mounted on a top face 238 of the PCB 232 and two other transformers 236 are mounted on a bottom face 240 of the PCB 232. A plurality of common mode chokes 242 surface-mounted on the PCB 232, wherein two mounted on the top face 238 and the other two mounted on the bottom face 240. A plurality of capacitors 244 and resistors 246 are mounted on the top face 238 and bottom face 240. A row of front conductive pads 246 and a row of rear conductive pads 248 formed on the bottom face 240. The mating contacts 234 are surface-mounted to the corresponding front conductive pads 246. The receptacle connector 200 is surface-mounted to the PCB 232 by the rear conductive pads 248. The transformers 236 are disposed between the front conductive pads 246 and the rear conductive pads 248 along the front-to-back direction. A plurality of conductive apertures 250 are formed on a rear wall of the PCB 232 and each conductive aperture 250 physically and electrically connects to the corresponding rear conductive pads 248. Each mating contact 234 has a connection portion 252 soldered to the corresponding front conductive pads 246, a front distal potion 254 inserted within the corresponding passageways 218, a mating portion 256 received within the mating cavity 204, and a horizontal portion 258 connected between the mating portion 256 and the connection portion 252. The mating portion 256 is a deflectable cantilever.

A metallic shell 260 enclosed the inslulative case 202 has a pair of spring tabs 262 extending downwardly through the corresponding through-holes 216 to reach the mating cavity 204 and a pair of grounding tab 264 protruded outwardly from a side wall 266 to solder on the PCB 400. The spring tabs 262 are forced within the corresponding locking holes 21, when the plug connector 100 is mated with the receptacle connector 200. Notably, the spring tabs 262 and the locking holes 21 retain the mating status of the plug connector 100 and the receptacle connector 200 and functions as the deflectable latch 20 locking with the stand RJ-45 modular jack.

Figure 9:
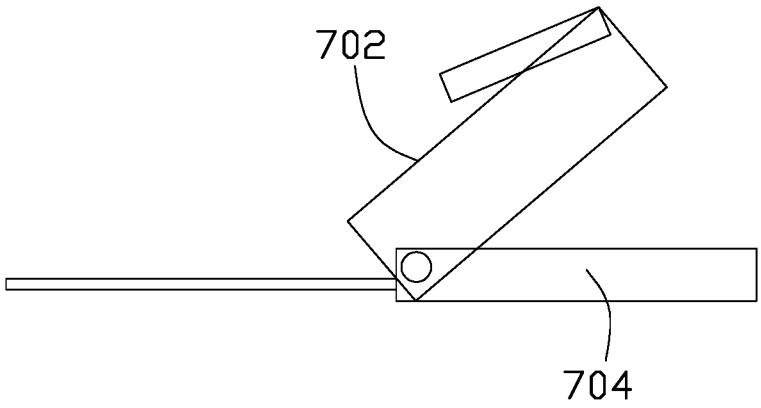
FIG. 9 is an illustrative figure to show the second embodiment of the invention wherein the terminal module is hinged about the housing so as to expose the front mating portion of the terminal module for independent mating with the thin receptacle.
Figure 10:
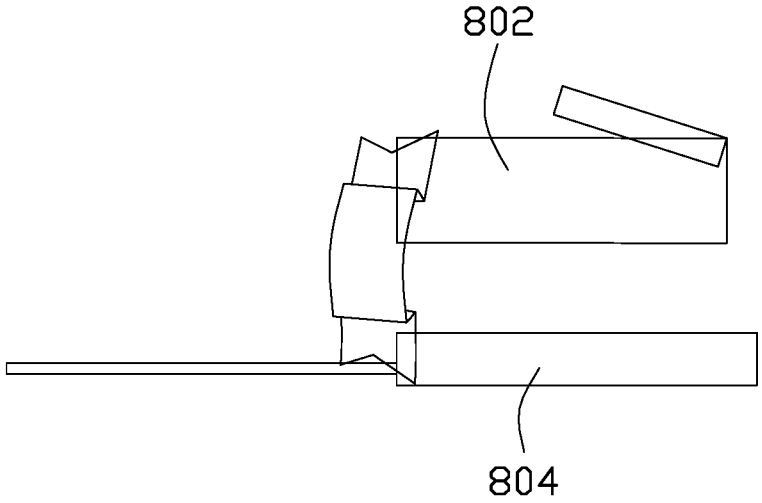
FIG. 10 is another illustrative figure to show the third embodiment of the invention wherein the terminal module is detachable from the housing to expose the front mating portion of the terminal module for independent mating with the thin receptacle.
Figure 11:
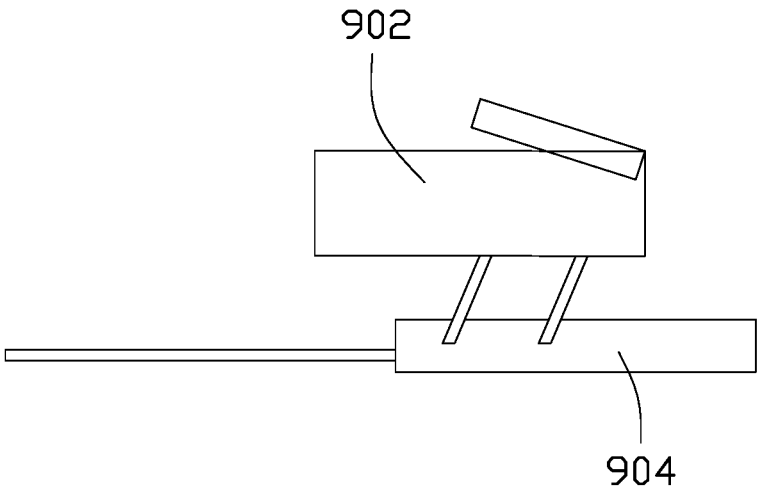
FIG. 11 is another illustrative figure to shown a fourth embodiment of the invention wherein the terminal module is linked to the housing via a pair of parallel pivotal shafts to have the housing translated with regard to the terminal module to expose the front mating portion of the terminal module for independent mating with the thin receptacle.

FIG. 9 shows the second embodiment wherein the housing 702 is pivotal about the terminal module 704. FIG. 10 shows the third embodiment wherein the housing 802 is able to be detachable from the terminal module 804 while being also attachable via the post-hole structure or deflectable latch structure (not shown) in the vertical direction or the rib-groove structure (not shown) in the front-to-back direction, etc. FIG. 11 shows the fourth embodiment wherein the housing 902 is able to be moveable relative to the terminal module 904 in a translation manner. In brief, the spirit of the invention is to provide a plug connector with the same internal contact arrangement and the variable contour to mate, in an mutually exclusive manner, with either the standard/regular interfaced RJ-45 modular jack or a thin receptacle built in the tablet or ultrabook computer disregarding how such a variation is obtained.

FIGS. 18-23 shows the fifth embodiment wherein the extendable plug connector 100 is replaced with a standard RJ-45 plug connector 500 and an adapter 600. The standard RJ-45 plug connector 500 is adapted to be mated with the standard RJ-45 module jack which is popularly used for the communication servers or the Internet connection of the computer. The adapter 600 has an insulative body 602 with a first body 604 mated with the RJ-45 plug connector 500 and a second body 606 mated with the thin receptacle connector 200. The first body 604 has a receiving cavity 608 extending along the front-to-back direction and a locking cutout 610 communicating with the receiving cavity 608 along the vertical direction. The standard RJ-45 plug connector 500 has an insulative housing 502 and a deflectable latch 504 extending backwardly and upwardly from a top side thereof. A front portion of the insulative housing 502 is inserted into the receiving cavity 608 and the deflectable latch 504 is engaged with the locking cutout 610, when the standard RJ-45 plug connector 500 is mounted with the adapter 600. The second body 606 is thinner than the first body 604 in the vertical direction. The second body 606 defines a pair of locking holes (not shown) to lock with the spring tabs 262 of the receptacle connector 200. A plurality of passageways are formed in a bottom wall 618 and a middle wall 619 of the insulative body 602, wherein each passageway includes a front passageway 612 formed on the first body 604 and communicated with the receiving cavity 608 , a rear passageway 614 formed on the second body 606 and open downwardly, and a upward passageway 616 extending through the middle wall 619.

A plurality of terminals 620 received in the insulative body 602, wherein each terminal 620 has a front mating section 622 extending backwardly and upwardly in the receiving cavity 608, a middle section 624 received in the corresponding front passageway 612, and a rear mating section 626 received in the corresponding rear passageways 616. The distal ends of the front mating sections 622 are received within the corresponding the rear passageways 616. The middle sections 624 are received within the corresponding front passageways 612. The rear mating sections 626 are received within the corresponding rear passageways 614 and extend backwardly and upwardly and communicates exterior along the vertical direction.

What is claimed is:

1. A plug connector comprising:

an insulative housing configured to mate with an RJ-45 modular jack along a front-to-back direction; and a terminal module moveable relative to the housing and including an insulator enclosing a plurality of contacts configured to mate with corresponding terminals of the RJ-45 modular jack, the contacts arranged in a row along a transverse direction perpendicular to the front-to-back direction; wherein a front mating portion of the terminal module is dimensioned less than the housing in a vertical direction perpendicular to both the front-to-back direction and the transverse direction so as to be mated independently with a thin receptacle connector which is thinner than the RJ-45 modular jack in said vertical direction.

2. The plug connector as claimed in claim 1, wherein said terminal module is configured to be slidable relative to the housing along the front-to-back direction.

3. The plug connector as claimed in claim 1, wherein said terminal module is configured to be either rotatable or translated with regard to the housing.

4. The plug connector as claimed in claim 1, wherein the insulator is dimensioned smaller than the housing in the transverse direction.

5. The plug connector as claimed in claim 1, wherein said housing forms a receiving space in which said terminal module is moveable along the front-to-back direction.

6. The plug connector as claimed in claim 5, wherein said housing is open to an exterior to allow the terminal module to be assembled into the receiving space from a bottom side of the housing.

7. The plug connector as claimed in claim 6, wherein said housing forms a pair of blocks and the terminal module forms a pair of grooves to receive the corresponding blocks during upwardly assembling the terminal module into the housing from the bottom side.

8. The plug connector as claimed in claim 5, wherein the terminal module is moveable between a front extended position beyond a front edge of the housing and a rear retracted position flush with the front edge of the housing.

9. The plug connector as claimed in claim 8, wherein the housing and the terminal module are equipped with positioning retention structures to maintain the terminal module in the front extended position or the rear retracted position.

10. The plug connector as claimed in claim 1, wherein the housing forms a receiving space, and the terminal module is fully received within the receiving space in both said vertical direction and the transverse direction.

11. The plug connector as claimed in claim 1, wherein said housing is integrally formed with a deflectable latch.

12. The plug connector as claimed in claim 1, further including a plurality of wires mechanically and electrically connected to the corresponding contacts, respectively, and said wires are associatively moveable along with the terminal module.

13. The plug connector as claimed in claim 12, wherein each of the contacts includes a front contacting section exposed downwardly to an exterior in the vertical direction, and a rear tail section spaced from the front contacting section with a distance in a front-to-back direction perpendicular to said vertical direction, and said wires mechanically and electrically are connected to the corresponding tail sections, respectively.

14. A plug connector comprising:

an insulative housing configured to be received within a mating cavity of a standard RJ-45 modular jack along a front-to-back direction; and a terminal module moveable relative to the housing and including an insulator enclosing a plurality of contacts configured to mate with corresponding terminals of the standard RJ-45 modular jack, the contacts arranged in a row along a transverse direction perpendicular to said front-to-back direction; wherein a front mating portion of the terminal module is dimensioned less than the mating cavity of the standard RJ-45 modular jack in a vertical direction perpendicular to both the front-to-back direction and the transverse direction so as to be mated independently with a thin receptacle connector which is thinner than the RJ-45 modular jack in said vertical direction.

15. The plug connector as claimed in claim 14, wherein the front mating portion of the terminal module is thinner than remaining portions of the terminal module.

16. The plug connector as claimed in claim 15, wherein each of the contacts includes a front contacting section exposed downwardly to an exterior in the vertical direction, and a rear tail section spaced from the front contacting section with a distance in the front-to-back direction, and a plurality of wires mechanically and electrically are connected to the corresponding tail sections, respectively.

17. The plug connector as claimed in claim 16, wherein said tail sections are located in the remaining portion, and the tail sections with the associate wires are located above the front mating portion in the vertical direction.

18. The plug connector as claimed in claim 14, wherein said housing is integrally formed with a deflectable latch.

19. The plug connector as claimed in claim 14, wherein said housing forms a receiving space in which said terminal module is fully received, and said housing is dimensioned to be snugly received within the mating cavity.

20. A plug connector comprising:

a housing configured to be received within a mating cavity of a standard RJ-45 modular jack along a front-to-back direction; and a terminal module moveable relative to the housing and including an insulator enclosing a plurality of blade type contacts configured to mate with corresponding terminals of the standard RJ-45 modular jack, the contacts arranged in a row along a transverse direction perpendicular to said front-to-back direction; wherein a front mating portion of the terminal module is dimensioned less than the mating cavity of the standard RJ-45 modular jack in a vertical direction perpendicular to both said front-to-back direction and said transveres direction so as to be mated with a thin receptacle connector which is thinner than the RJ-45 modular jack in said vertical direction; wherein each of the contacts includes a front contacting section exposed downwardly to an exterior in the vertical direction, and a rear tail section spaced from the front contacting section with a distance in said front-to-back direction perpendicular to said vertical direction, and a plurality of wires mechanically and electrically are connected to the corresponding tail sections, respectively.

* * * * *